US007797792B2

(12) United States Patent
Cipolla et al.

(10) Patent No.: US 7,797,792 B2
(45) Date of Patent: Sep. 21, 2010

(54) HARD FLOOR CLEANER

(75) Inventors: Mark E. Cipolla, Chardon, OH (US); Michael F. Wright, Stow, OH (US); John S. Murphy, Brookpark, OH (US); Richard C. Farone, Willoughby, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 1646 days.

(21) Appl. No.: 11/029,786

(22) Filed: Jan. 5, 2005

(65) Prior Publication Data

US 2006/0000051 A1 Jan. 5, 2006

Related U.S. Application Data

(63) Continuation of application No. 10/883,147, filed on Jul. 1, 2004, now Pat. No. 7,254,864.

(51) Int. Cl.
*A47L 9/10* (2006.01)

(52) U.S. Cl. ..... 15/353; 15/354; 15/355; 15/361; 15/363

(58) Field of Classification Search ..... 15/353, 15/354, 355, 361, 363
See application file for complete search history.

(56) References Cited

U.S. PATENT DOCUMENTS

| | | | | |
|---|---|---|---|---|
| 2,635,278 | A | 4/1953 | Belknap | |
| 2,989,769 | A | 6/1961 | Houser | |
| 3,263,908 | A | 8/1966 | Kroker et al. | |
| 3,267,511 | A | 8/1966 | Meyerhoefer | |
| 3,875,605 | A | 4/1975 | Fegan | |
| 4,055,504 | A | 10/1977 | Thun-Hohenstein | |
| 4,167,799 | A | 9/1979 | Webb | |
| 4,360,946 | A | 11/1982 | Marshall, Jr. et al. | |
| 4,429,433 | A | 2/1984 | Burgoon | |
| 5,455,982 | A | 10/1995 | Armstrong et al. | |
| 5,640,738 | A | 6/1997 | Williams et al. | |
| 6,009,594 | A | 1/2000 | Grey | |
| 6,076,228 | A | 6/2000 | Aiken | |
| 6,101,668 | A | 8/2000 | Grey | |
| 6,243,912 | B1 | 6/2001 | Grey | |
| 6,286,181 | B1 | 9/2001 | Kasper et al. | |
| 6,438,793 | B1 * | 8/2002 | Miner et al. | 15/320 |
| 6,519,807 | B1 * | 2/2003 | Thomson | 15/354 |

(Continued)

FOREIGN PATENT DOCUMENTS

| | | |
|---|---|---|
| EP | 0 940 735 | 9/1999 |

(Continued)

*Primary Examiner*—Shay L Karls
(74) *Attorney, Agent, or Firm*—Michael Best & Friedrich LLP

(57) ABSTRACT

A floor cleaning device (10) includes a housing (40) and a container (43) removably received by the housing. A suction nozzle (18, 18', 18") is fluidly connected with the container and with a suction source (52) when the container is received by the housing. A filter (114) is selectively fluidly connected with the container and with the suction source. A float (170) selectively closes the fluid connection of the filter with the container. The filter and the float may be removable as a unit (42) from the cleaning device. The nozzle may be removable, allowing an appropriate nozzle to be selected according to the type of floor surface to be cleaned.

21 Claims, 19 Drawing Sheets

U.S. PATENT DOCUMENTS

| | | | | |
|---|---|---|---|---|
| 6,629,332 | B2 | 10/2003 | Morgan et al. | |
| 6,640,386 | B2 * | 11/2003 | Morgan et al. | 15/373 |
| 6,647,578 | B2 | 11/2003 | Morgan et al. | |
| 6,832,409 | B2 | 12/2004 | Morgan et al. | |
| 2002/0092116 | A1 | 7/2002 | Zahuranec et al. | |
| 2003/0051309 | A1 | 3/2003 | Morgan et al. | |
| 2003/0051310 | A1 | 3/2003 | Morgan et al. | |

FOREIGN PATENT DOCUMENTS

| | | |
|---|---|---|
| GB | 1210536 | 11/1967 |
| GB | 2 239 789 | 7/1991 |
| GB | 2 322 066 | 8/1998 |
| WO | WO 94/08502 | 4/1994 |

* cited by examiner

HARD FLOOR CLEANER

This application is a continuation of U.S. application Ser. No. 10/883,147 which was filed on Jul. 1, 2004, now U.S. Pat. No. 7,254,864.

BACKGROUND

1. Field of the Invention

The present invention relates to floor care devices. More particularly, the present invention relates to a collection assembly for a hard floor cleaning device. However, it is to be appreciated that the present exemplary embodiment is also amenable to other like applications.

2. Discussion of the Art

Floor cleaning devices have been developed for cleaning hard floors to replace a conventional mop and bucket. Such devices often have an on-board tank for cleaning liquid and a cleaning head which is adapted to apply the cleaning liquid to the floor and remove dirty cleaning fluid therefrom. Vacuum cleaners are used for removal of dry dirt but are generally unsuited to the pick-up of liquids. It has been found advantageous to develop a single device able to perform both wet and dry floor cleaning operations. U.S. Pat. No. 6,101,668 to Grey, for example, discloses a floor cleaning device with a combined cleaning liquid and recovery tank which is carried on a handle of the device. Squeegees are mounted to a cleaning head for assisting in wet floor cleaning. One disadvantage in such a system is that it requires different separator systems for dry and wet cleaning modes.

The present invention provides a new and improved floor cleaning device and method of use, which overcome the above-referenced problems and others.

SUMMARY OF THE INVENTION

In accordance with one aspect of the present invention, a cleaning device is provided. The cleaning device includes a housing. A container is removably received by the housing. The container defines an inlet tube and an outlet. A suction source is mounted on the housing and is fluidly connected with the outlet of the container. An annular float selectively closes the fluid flowpath. The float is located in the container and surrounds the inlet tube.

In accordance with another aspect of the invention, a cleaning device is provided. The device includes a housing. A container is removably received by the housing. The container defines an inlet and an outlet. A suction source is fluidly connected with the outlet of the container. A suction nozzle fluidly communicates with the inlet of the container and with the suction source via a fluid flowpath when the container is received by the housing. A float and filter assembly includes a filter, a filter receptacle which receives the filter; and a float which selectively closes the fluid flowpath. One of the float and the filter receptacle includes an engagement member for engagement with the other of the float and the filter receptacle whereby the float is movable in a direction parallel to a longitudinal axis of the container between a first position and a second position.

In accordance with another aspect of the invention, a collection assembly for a surface cleaning device is provided. The collection assembly includes a container which comprises a compartment for receiving recovered cleaning fluid. The container has an inlet tube, through which the recovered fluid and entrained air enter the compartment, and an outlet. A filter and float assembly is carried by the container for filtering dirt from entrained air entering the container until a level of liquid in the container reaches a preselected level. The float surrounds the inlet tube.

In accordance with another aspect of the invention, a method for cleaning a floor is provided. The method includes providing an upright cleaning device including a floor nozzle and an upper housing accommodating a container with a compartment for receiving recovered cleaning liquid. The container includes an inlet tube. A float and filter assembly is carried by the container. A cleaning liquid is applied to the floor. The cleaning liquid is suctioned from the floor into the compartment through the inlet tube. A flowpath of entrained air between the compartment and the filter is closed when a level of the dirty cleaning fluid causes the float to close. The float is guided between first and second positions in relation to the inlet tube.

In accordance with another aspect of the invention, a cleaning device is provided. The cleaning device includes a base. A container is carried by the base for receiving dirt from a surface to be cleaned. A source of suction is in fluid communication with the container. A suction nozzle is carried by the base. The suction nozzle includes an inlet for receiving dirt from the surface to be cleaned and an outlet. The suction nozzle is movable, relative to the base, between a first position, in which the inlet is located adjacent the surface to be cleaned and a second position, in which the inlet is spaced from the surface. The suction nozzle outlet is in fluid communication with the container and with the source of suction in both the first and second positions of the suction nozzle.

In accordance with another aspect of the invention, a cleaning device is provided. The device includes a base. A container is carried by the base for receiving dirt from a surface to be cleaned. A source of suction is in fluid communication with the container. A plurality of interchangeable suction nozzles are configured for selective connection with the base. Each of the suction nozzles includes an inlet for receiving dirt from the surface to be cleaned and an outlet.

The advantages of the present invention will be readily apparent to those skilled in the art, upon a reading of the following disclosure and a review of the accompanying drawings.

BRIEF DESCRIPTION OF THE DRAWINGS

The invention is described in conjunction with accompanying drawings. The drawings are for purposes of illustrating exemplary embodiments of the invention and are not to be construed as limiting the invention to such embodiments. It is understood that the invention may take form in various components and arrangements of components and in various steps and arrangements of steps beyond those provided in the drawings and associated description.

DETAILED DESCRIPTION

Figure 1:
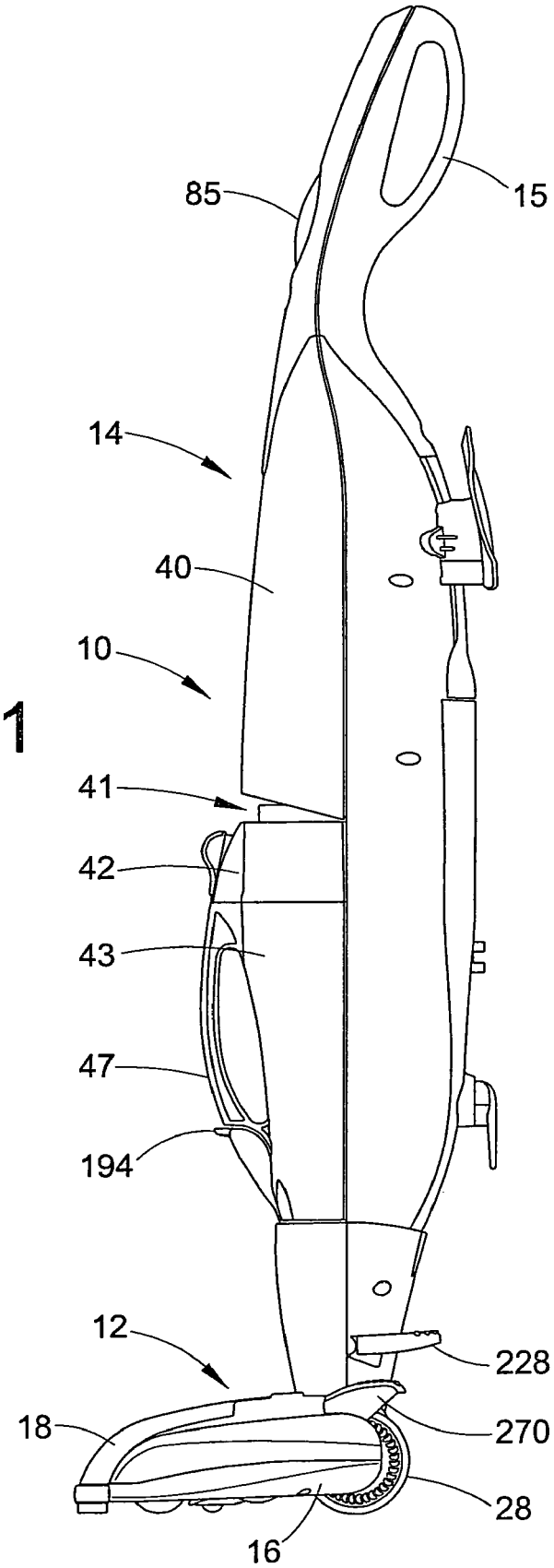
FIG. 1 is a side elevational view of a floor cleaning device according to the present invention.

Referring now to the FIGURES, wherein the showings are for purposes of illustrating several preferred embodiments of the invention only and not for purposes of limiting the same, FIG. 1 shows a cleaning device 10 which includes a base 12 for contacting a hard floor surface and a handle assembly 14, which is pivotally attached to the base. A hand grip 15 is provided at an upper end of the handle assembly. During floor cleaning, the handle assembly 14 is positioned at an acute angle to the direction of travel of the base 12, and the hand grip 15 is held for directing the base across a floor surface to be cleaned.

Figure 2:
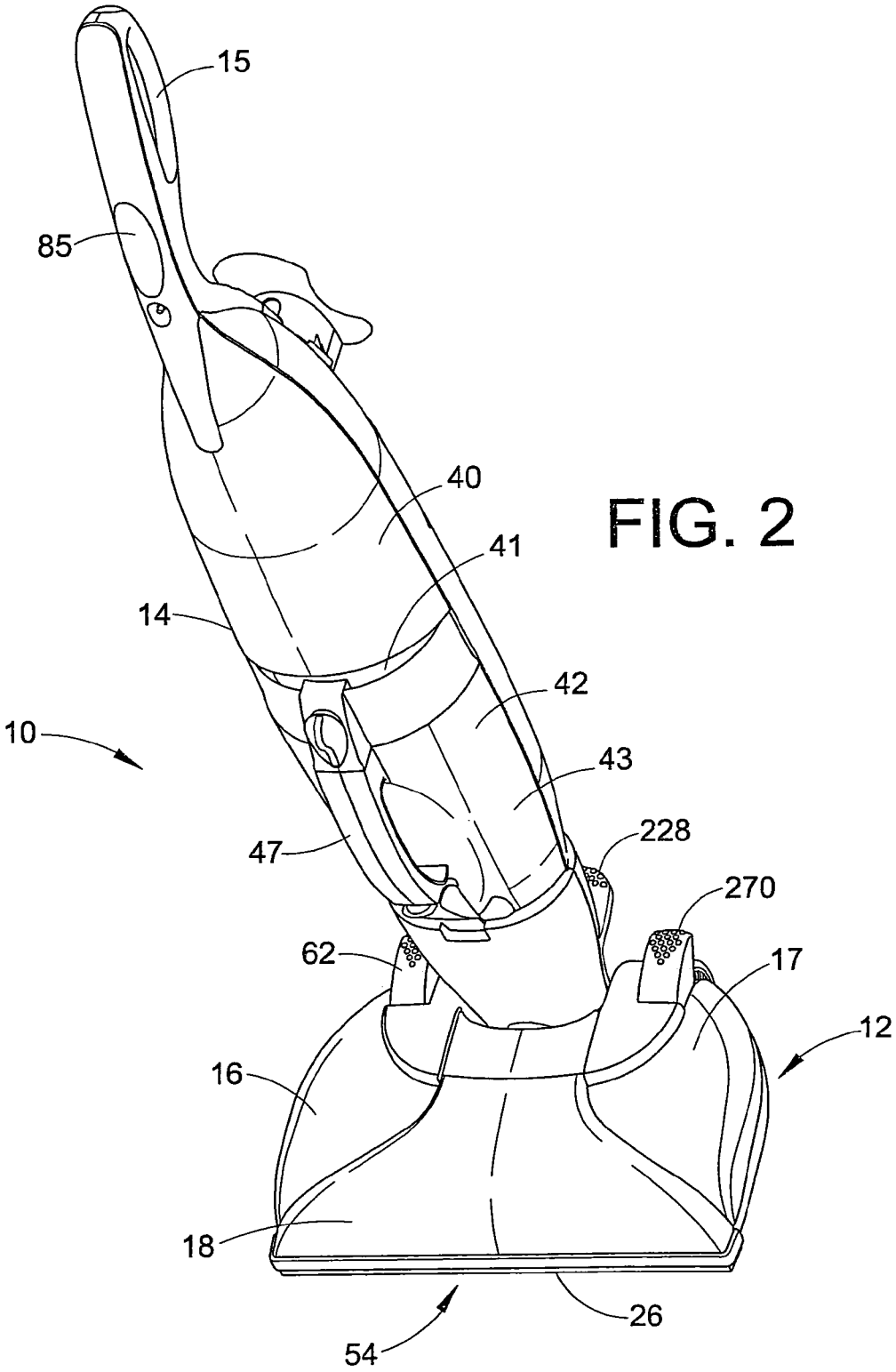
FIG. 2 is a top perspective view of the floor cleaning device of FIG. 1.
Figure 3:
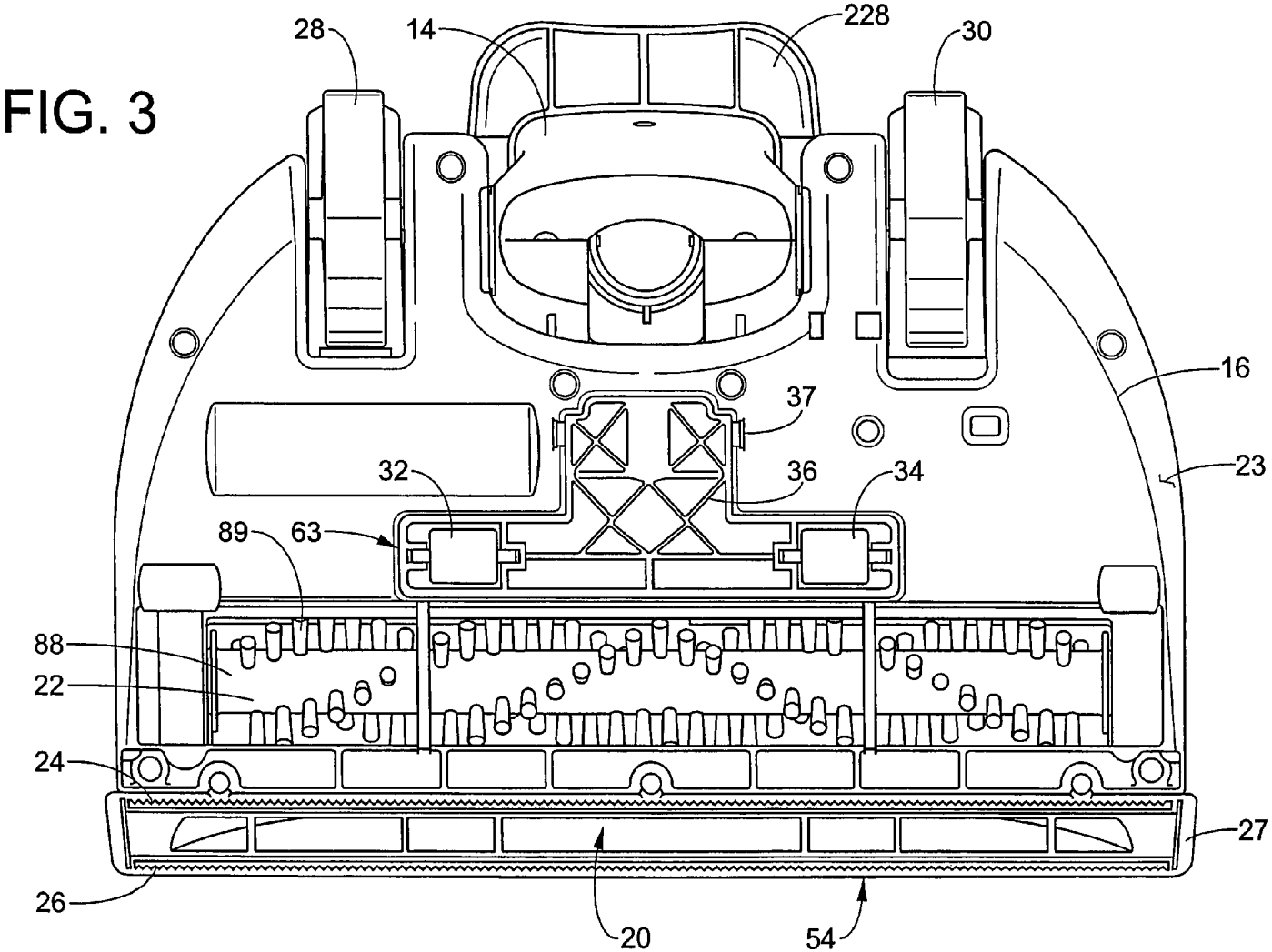
FIG. 3 is an enlarged bottom perspective view of a lower end of the floor cleaning device of FIG. 1.
Figure 5:
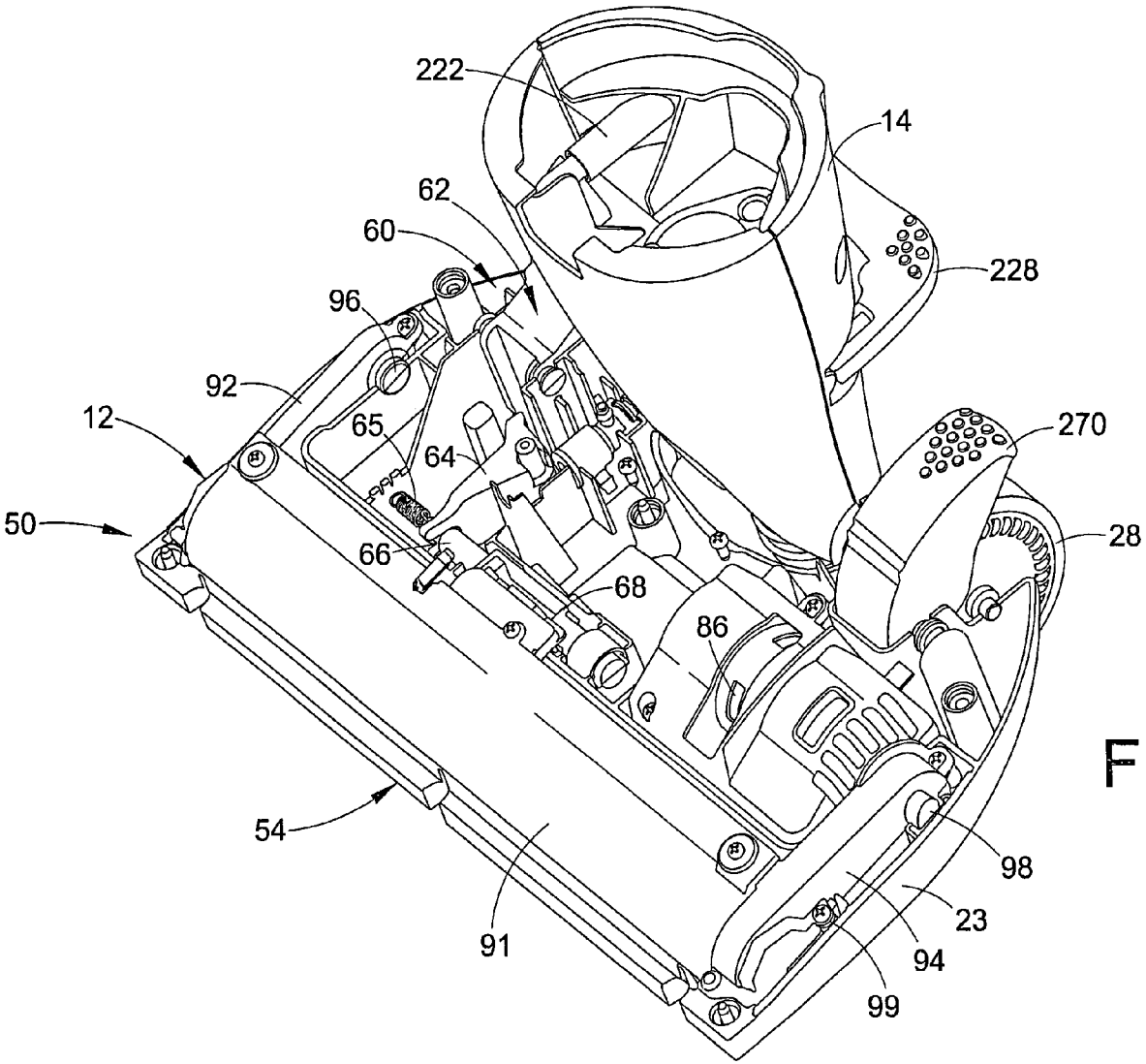
FIG. 5 is a top perspective view of a lower end of the cleaning device of FIG. 1, with portions of the base housing and nozzle assembly removed for clarity.

With reference also to FIG. 2, the base 12 of the hard floor cleaning device includes a base housing 16 having an upper portion 17. A suction nozzle 18 overlies the upper portion 17 and defines a suction inlet 20 (FIG. 3) for recovery of dry dirt and/or dirty liquid from the floor and an outlet 21. An agitator 22 (FIG. 3), such as a rotating brush assembly, is carried by a lower portion 23 of the base housing 16 for scrubbing the floor. The base housing 16 also carries at least one flexible strip or squeegee 24, 26, formed from a conventional flexible material, to aid in pickup of liquids. As illustrated in FIG. 3, rear and front squeegees 24, 26 are mounted by a squeegee support 27 to the suction nozzle 18, such that they are positioned rearward and forward of the suction inlet 20. Rotation members, such as rear wheels 28, 30 are mounted to a rear of the base housing 16, on either side of the handle assembly 14. Forward rotation members, such as wheels or rollers 32, 34 are carried by a carriage assembly 36 which is pivotally mounted at pivot points 37 to the lower portion 23 of the base housing 16 (FIG. 5).

Figure 6:
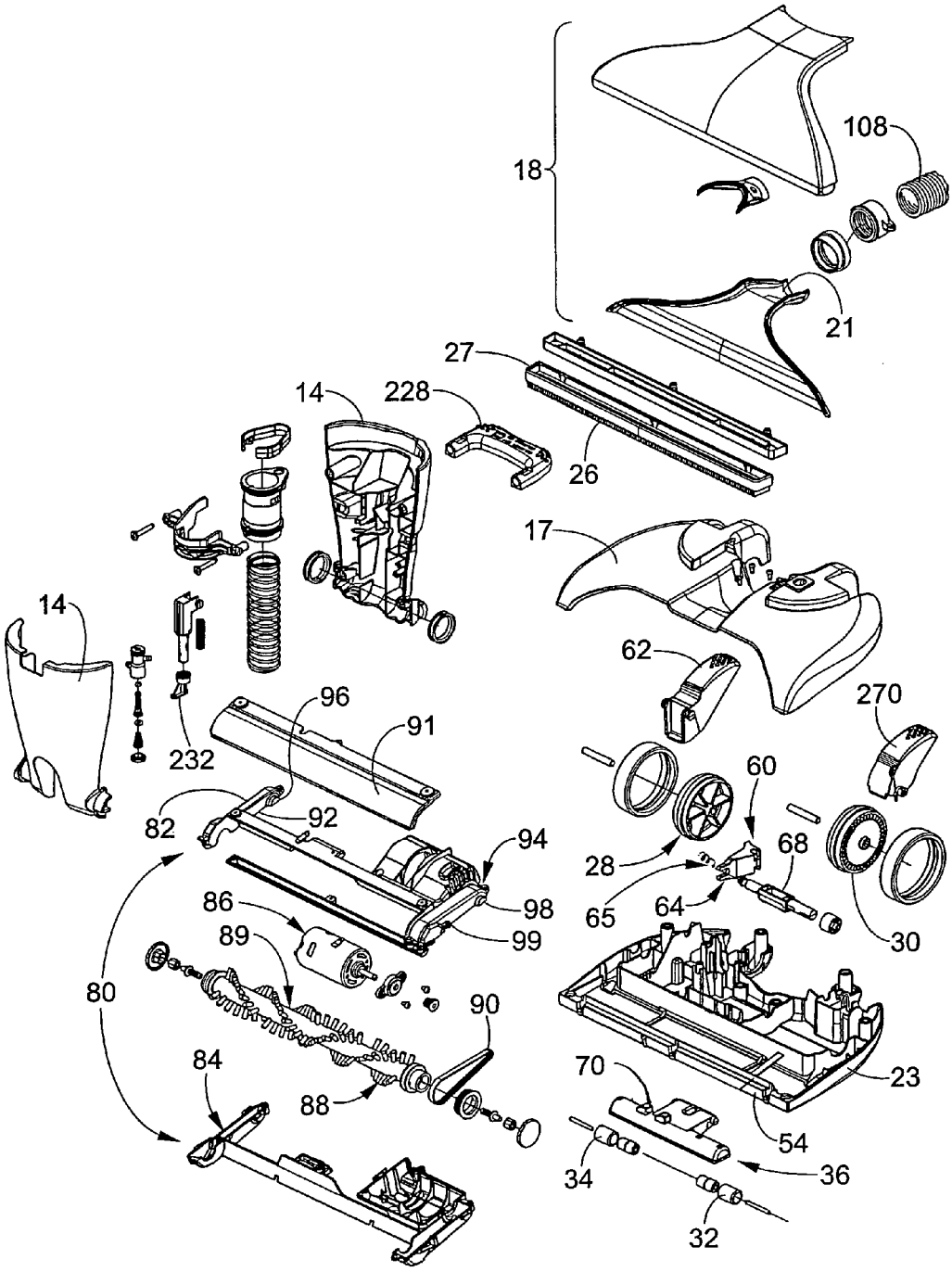
FIG. 6 is an exploded perspective view of the base and lower portion of the handle assembly of the floor cleaner of FIG. 1.

The suction nozzle 18 is formed from upper and lower members 38, 39, best shown in FIG. 6 which are connected together to define the inlet 20 and the outlet 21 and a portion of a fluid flowpath A therebetween. The nozzle assembly lower member 39 contacts the upper portion 17 of the base housing.

Figure 4:
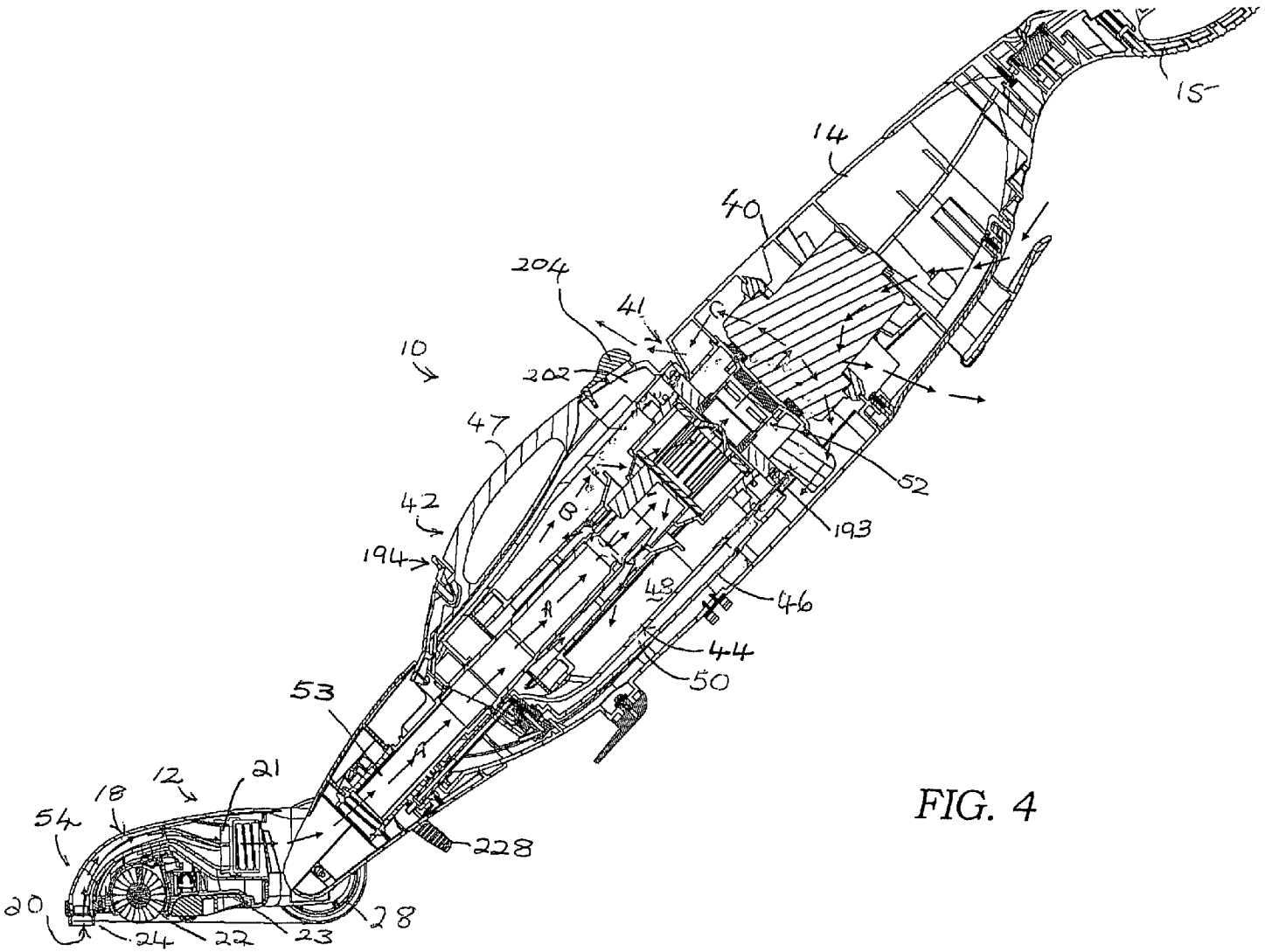
FIG. 4 is an enlarged side sectional view of the floor cleaning device of FIG. 1.

With reference now to FIG. 4, the handle assembly 14 includes an upper housing 40 in which is defined a socket 41. A removable fluid collection assembly 42 is received at least partially within the socket 41 and serves as a recovery tank for dirty cleaning liquid and/or dry dirt and as a reservoir of fresh cleaning liquid. The collection assembly 42 may include a container 43 which defines first and second compartments for separately holding the cleaning liquid and dry dirt/dirty cleaning liquid which has been recovered from the floor. Specifically, the container 43 has an inner section 44, which is mounted within an outer section 46 having an integral handle 47. In cooperation, the two sections 44, 46 define an inner recovery chamber 48, for collecting the dry dirt and dirty liquid picked up by the suction inlet 20, and a reservoir chamber 50, between the inner and outer sections 44, 46, for storing fresh cleaning liquid for distribution onto the floor.

While in the illustrated embodiment, the recovery chamber 48 and reservoir chamber 50 are defined by a single container 43, it is also contemplated that separate recovery and cleaning liquid tanks may be provided. Additionally, while the container 43 is illustrated as being carried by the handle assembly 14 of the cleaning device, it is also contemplated that the container may alternatively be carried in whole or in part by the base 12 of the cleaning device. In yet another embodiment, the floor cleaning device is of the canister type and lacks a directing handle. In such an embodiment, the container 43 can be carried by a wheeled housing and the suction nozzle fluidly connected to the wheeled housing by a wand.

A source of suction 52, such as a fan and motor assembly, applies suction to the recovery chamber 48, thereby drawing dry dirt and/or dirty cleaning liquid and entrained air from the suction inlet 20 on the base into the recovery chamber via a suction duct 53, which defines a portion of the flowpath marked by arrows A. In the illustrated embodiment, the fan and motor assembly 52 is mounted within the handle assembly housing 40, above the socket 41, although other locations are also contemplated.

The hard floor cleaning device 10 can be used for dry and wet modes of cleaning, as described in greater detail below. In the dry mode, a forward end 54 of the base 12 can be raised, relative to the floor surface, to improve pick up of dry dirt. Raising the base forward end 54 raises the suction inlet 20 and squeegee(s) 24, 26 a small distance away from the floor surface. In the wet mode, the forward end 54 of the base can be lowered to allow the squeegees 24, 26 to engage the floor surface for improved pickup of liquids.

With reference now to FIG. 5, which shows the base 12 with the upper housing portion 17 of the base housing 16 and suction nozzle 18 removed, a height adjustment mechanism 60 raises and lowers the forward end 54 of the base. The height adjustment mechanism includes a foot operated pedal 62, pivotally mounted to the base housing. When depressed, the pedal 62 causes the front end of the wheeled carriage 36 (FIG. 3) to pivot, relative to the rest of the base, from a extended (lowered) position to a retracted (raised) position. With the carriage in its extended position, the rollers 32, 34 are displaced away from the lower portion 23 of the base housing 16, thereby raising the forward end 54 of the base.

With the carriage in its retracted position, the carriage is retracted into a downwardly opening pocket 63 (FIG. 3) in the base housing 16, thereby lowering the forward end 54 of the base. Further depression of the foot pedal 62 returns the carriage 36 to its extended position. Specifically, as shown in FIG. 5, depression of the pedal pivots a lever 64, overcoming the biasing force of a spring 65. In turn, the pivoting of the lever 64 actuates a pen-type actuator 66 with a cam foot 68, best shown in exploded perspective view in FIG. 6. The pen type actuator 66 shifts the cam foot 68 in one direction. The cam foot rises up a camming surface 70 on the carriage 36, raising the base housing and effectively lowering the front rollers 32, 34. A second depression of the pedal 62 shifts the cam foot 68 in the opposite direction, returning the forward end 54 of the base 12 to the lowered position by retracting the carriage 36.

In one embodiment, the agitator 22 is fixed, relative to the base housing 16, and is thus raised and lowered as the forward end 54 of the base is lowered. The agitator may be spaced from the floor surface in the raised (upper) position, or may maintain at least a limited contact with the floor. In another embodiment, the agitator 22 is free floating, so that it maintains contact with the floor in both raised and lowered positions.

With continued reference to FIG. 6, the brush assembly 22 includes a frame 80 formed from upper and lower frame members 82, 84. As switch 85 mounted on the handle assembly 16 (FIG. 2) selectively supplies power to a brushroll motor 86. The brushroll motor is mounted to the frame 80 and drivably connected with a brushroll 88 by a drive belt 90. The brushroll 88 includes bristles 89 and is rotatably mounted to a forward end of the frame 80. A brushroll cover 91 is mounted to the frame 80 to deflect clean fluid downwardly. The frame includes arms 92, 94, which extend rearwardly of the brushroll. In the free-floating embodiment, the arms are pivotally mounted to the lower portion 23 of the base housing at pivot points 96, 98 so that the brushroll 88 floats, relative to the base housing. The weight of the brushroll, optionally assisted by a bias spring (not shown) maintains the brushroll 88 in contact with the floor surface in both the raised and lowered positions of the carriage 36.

In the fixed brushroll embodiment, the frame 80 is fixed against movement relative to the base housing 16 so that the brushroll 88 is raised and lowered as the front end 54 of the base housing is raised and lowered. For example, forward ends of the arms 92, 94 are fixed to the lower portion of the base housing with screws 99 (FIG. 5) or other suitable fixing members. In one embodiment, the bristles 89 of the brushroll 88 are of sufficient length that they engage the floor even when the front end 54 of the base is in the raised position.

Figure 7:
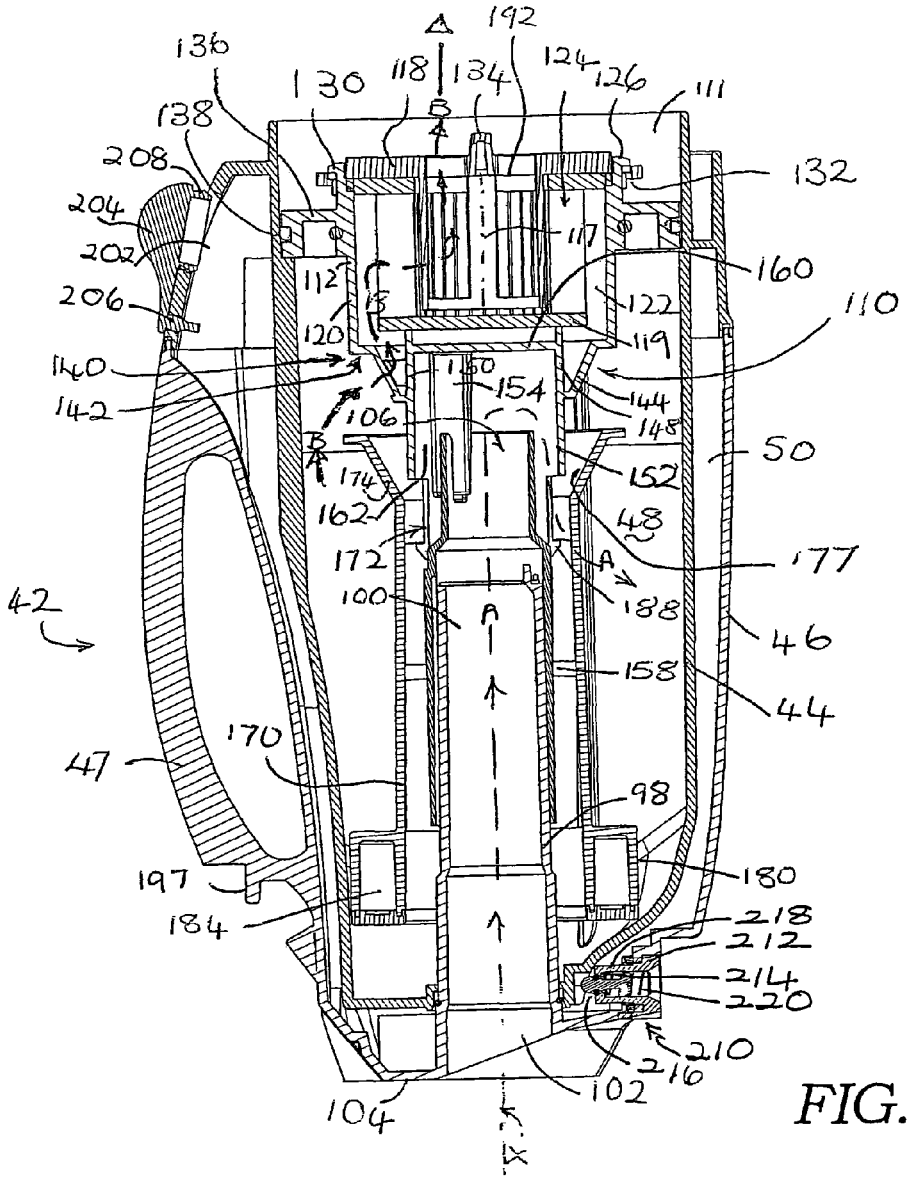
FIG. 7 is an enlarged side sectional view of the cleaning liquid and recovery container of FIG. 4 and a first embodiment of a filter and float assembly.

With reference now to FIG. 7, the collection assembly 42 for clean and recovered cleaning liquid includes a vertically extending suction tube 98, which defines part of a fluid inlet conduit 100. The conduit 100 extends into the recovery chamber 48 from an inlet 102 at a lower end 104 of the outer container 46 to an outlet 106, which is positioned about two thirds of the way up the recovery chamber. Recovered dry dirt or dirty liquid travels up the conduit 100, following the path indicated by arrows A. When the container 43 is inserted in the socket, the inlet 102 is fluidly connected with the suction duct 53 (FIG. 4).

Figure 9:
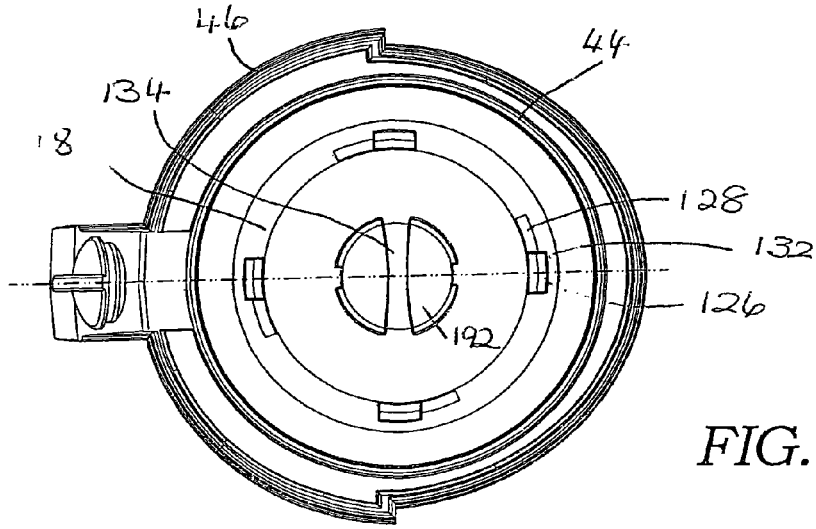
FIG. 9 is a top view of the cleaning liquid and recovery container and filter and float assembly of FIG. 7.

The collection assembly 42 further includes a removable float and filter assembly 110. The float and filter assembly 110 is seated in the inner section 44 so as to surround at least an upper end of the inlet conduit 100 and can be used in both wet and dry cleaning modes. The float and filter assembly 110 can be inserted into the chamber 48, as a unit, via an upper opening 111 in the inner section 44. The assembly 110, shown in exploded perspective view in FIG. 8, includes a filter receptacle or housing 112 which receives a filter 114. The filter may comprise a cylindrical pleated filter member 116 carried by a filter frame 117. The filter frame 117 includes a generally circular top plate 118 located at an upper end of the filter member 116 and a base wall 119 located at a lower end of the filter. The plate 118 is joined to the base wall 119 by internal frame members (not shown). The filter housing 112 includes a generally cylindrical wall 120 which defines an interior chamber 122 (FIG. 7) with an upper opening 124 for receiving the filter 114 therein. The top plate 118 of the filter sits in the upper opening 124. Tangs 126 extend upwardly from the cylindrical wall 120 (four angularly spaced tangs are shown in the illustrated embodiment) and are received through corresponding slots 128 in the filter plate 118, as shown in FIG. 9. When the filter plate 118 is rotated, relative to the filter housing 112, shoulder portions 130 (FIG. 7) of the tangs 126 engage a peripheral portion 132 (FIG. 9) of the plate 118, where the slots 128 are narrowed, thus locking the filter 114 to the filter housing 112. A suitably shaped handle 134 extends from a central region of the plate 118 for grasping during insertion and removal of the float and filter assembly and to assist in manually rotating the plate 118 during locking and unlocking.

Figure 8:
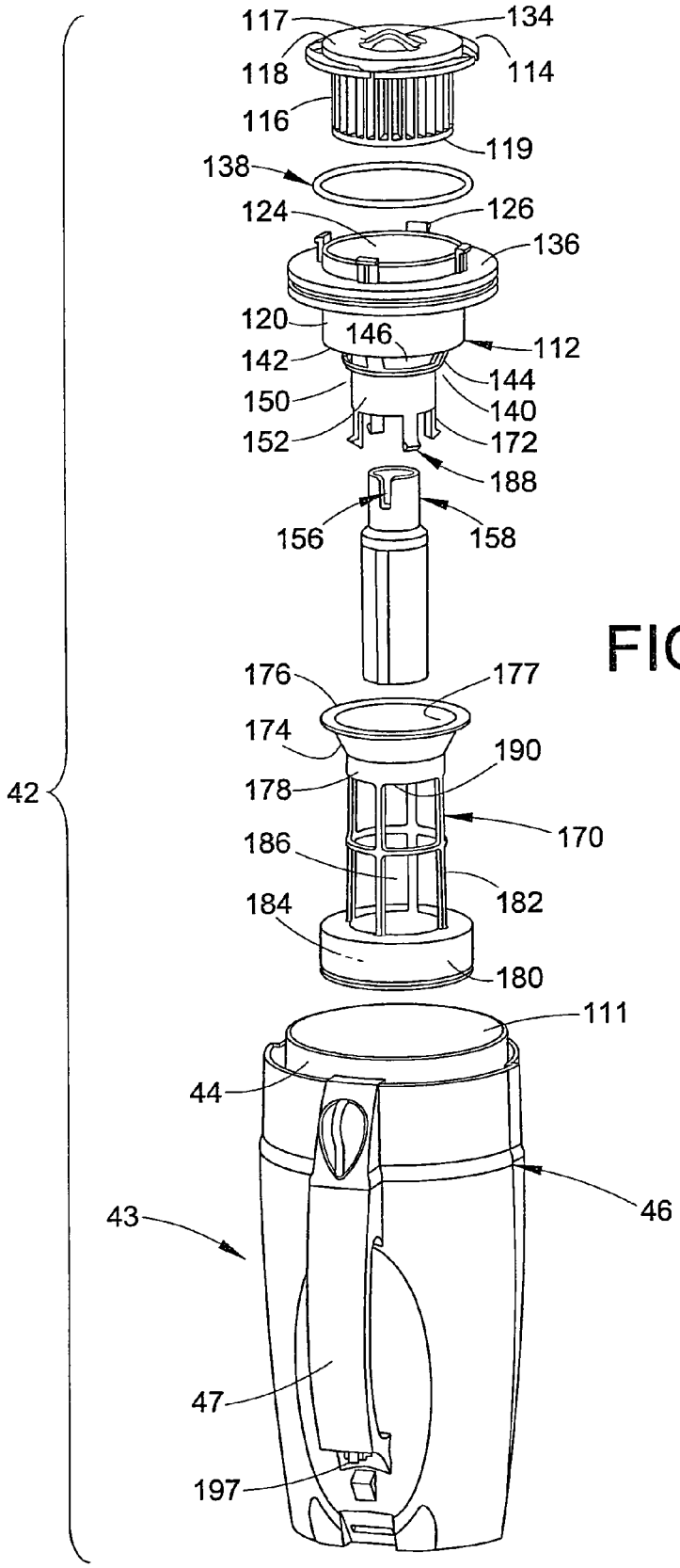
FIG. 8 is an exploded perspective view of the cleaning fluid and recovery container and float and filter assembly of FIG. 7.

With continued reference to FIG. 8, the filter housing 112 includes an outwardly extending flange 136, adjacent the tangs 126, which carries a gasket 138 for creating a seal between the filter housing 112 and the inner section 44 of the container 43.

A lower portion 140 of the filter housing wall 120, situated below the filter 114, is stepped to define a shelf 142, which connects the wall 120 with an inwardly sloping frustoconical portion 144. The frustoconical portion 144 defines at least one aperture 146 (two apertures 146 are illustrated in FIG. 8) through which air enters the filter chamber 122 from the inner chamber 48. An upper portion 148 of a vertically extending cylindrical tube 150 protrudes from a lower end of the frustoconical portion up to a location adjacent the base 119 of the filter frame to guide the incoming air into the filter 114 along a tortuous path denoted by arrows B.

A lower portion 152 of the tube 150 extends below the frustoconical portion 144. A longitudinally extending flange 154 (FIG. 7) extends radially inwardly from the lower tube portion 152. The flange 154 is received in a slot 156 (FIG. 8) defined by a cylindrical water separation tube 158. The tube 158 is mounted on the suction tube 98 to define an upper end of the inlet conduit 100. The flange 154 acts as a baffle which assists in directing the liquid away from the apertures 146. The flange 154, in cooperation with the tube 158, also ensures that the filter housing 112 is correctly positioned in the chamber 48 an appropriate distance above the base of the inner container 44.

The lower tube portion 152 surrounds the conduit 100. The tube 150 is closed, adjacent an upper end thereof, by a horizontal wall 160. The dry dirt or dirty cleaning fluid exiting the conduit outlet 106 is thus directed downward along an annular-shaped pathway 162 defined between the tube portion 152 and the water separation tube 158. The pathway is closed at its upper end by the wall 160.

Figure 10:
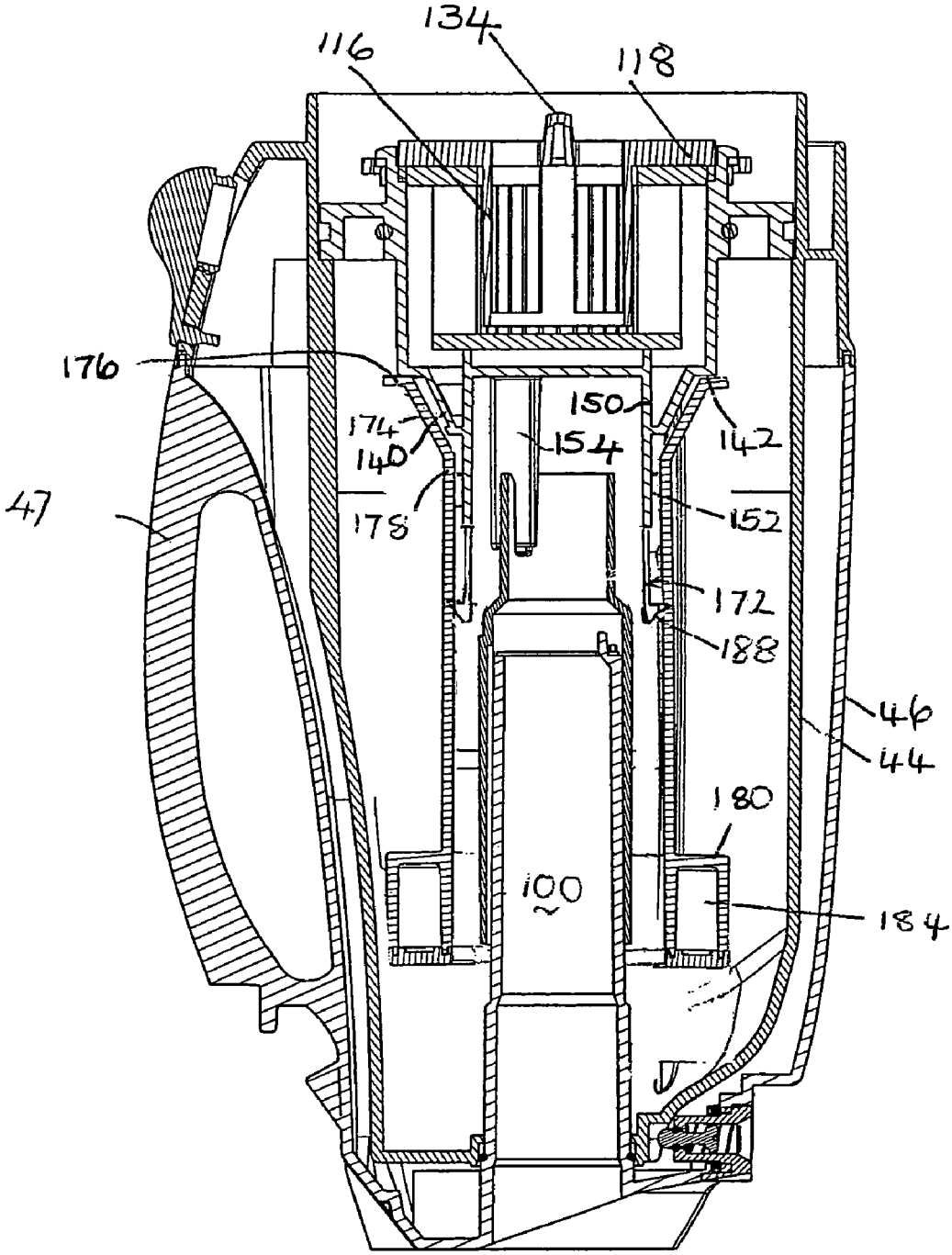
FIG. 10 is an enlarged side sectional view of the cleaning liquid and recovery container of FIG. 7 with a float in an upper position.

The float and filter assembly 110 also includes a float 170, which is carried by the filter housing 112. Specifically, engagement members 172 on either the float 170 and/or filter housing 112 engage the other of the float and filter housing while allowing relative movement of the float in relation to the filter housing. The engagement means also permits the float to be suspended by the filter housing during insertion and removal of the float and filter assembly 110 to and from the container 43. In one embodiment, the engagement means comprise a second set of tangs 172, which extend downwardly from the tube portion 152 and are shaped to engage the float 170 while allowing the float a limited amount of upward movement, relative to the filter housing 112. As the liquid level rises, the float 170 moves in a direction parallel to a longitudinal axis X of the container, guided along its path by the inlet tube 98. In this way, the float is less prone to accidental closing of the fluid flowpath when the handle assembly is tipped than where a pivoting float is employed. The float 170 includes a frustoconical portion 174, having an upper lip 176 extending radially outward therefrom. The frustoconical portion has a sloping inner surface 177 (FIG. 7). A cylindrical portion 178 extends from the frustoconical portion and has a diameter only slightly larger than that of the lower portion 152 of the tube. Thus, as illustrated in FIG. 10, when the float 170 is buoyed to an upper position by the level of recovered liquid in the recovery chamber 48, the openings 146 are closed. Specifically, in the upper position, the frustoconical portion 174 is shaped to surround the frustoconical portion 140 of the filter support with the lip 176 contacting the shelf 142 and the cylindrical portion 178 slidably engaging the tube 152.

As best shown in FIG. 8, the float 170 includes an annular-shaped float housing 180, which is connected with the cylindrical portion 178 by longitudinally extending ribs 182 (four in the illustrated embodiment). The float housing defines an airtight chamber 184 (FIG. 7) whose buoyancy carries the float upward as the level of the liquid in the recovery chamber 48 rises. Alternatively, the float chamber 184 can be open at the bottom, with air trapped in the float chamber buoying the float upwardly.

The ribs 182 define a generally tubular shape configured for surrounding the inlet tube 98. Spaces 186 between the ribs receive outwardly extending distal ends 188 of the tangs 172 therethrough, which engage a lower surface 190 (FIG. 8) of the cylindrical portion 178 when the float is in a lower position, shown in FIG. 7, or otherwise suspended from the filter housing. When the level of liquid in the recovery chamber 48 is below a certain level, the lip 176 of the float is spaced from the shelf, allowing air to exit the recovery chamber through the apertures 146. The air enters the filter chamber 122 and passes through the pleated filter 116, exiting the filter through a central opening 192 in the plate 118. With the filter receptacle being made from a suitable thermoplastic material, or other resiliently flexible material, the tangs 172 are sufficiently flexible such that, during assembly of the float and filter assembly 110, they can deflect inward to allow the distal tips 188 to pass through the cylindrical portion 178. Once though, the tips spring outwardly to engage the float.

The tangs 172 prevent the float 170 from falling off the filter housing 112, allowing the filter housing, filter 114, and float to be removed from the recovery chamber as unit, simply by lifting the handle 134.

The fan and motor assembly 52 is seated in the upper open end 111 of the recovery chamber 48, above the float and filter assembly 110, such that air exiting the filter passes though the opening 192 and is expelled by the fan from the housing 40, as illustrated by arrows C in FIG. 4. The assembly 52 carries a gasket 193 for sealing a gap between the fan and motor assembly and the inner container 44. Power to the fan and motor assembly 52 is controlled by the switch 85, whereby the brushroll 88 rotates and suction is applied whenever the switch is in an on position. Alternatively, the brushroll and fan motor may be separately controlled so that they can be operated independently.

With reference now to FIG. 4, a locking mechanism 194 selectively locks the container 43 to the handle assembly 14. The locking mechanism 194 includes a resiliently flexible latch 195 (FIG. 11) which is pivotally connected to a lower portion of the handle housing 40. The latch defines a projection 196, which snap fits under a corresponding protection 197 (FIG. 7) on the container. To release the latch, a flexible tab 198 on the latch is depressed, which releases the latch projection 196 from engagement with the container projection 197.

Figure 12:
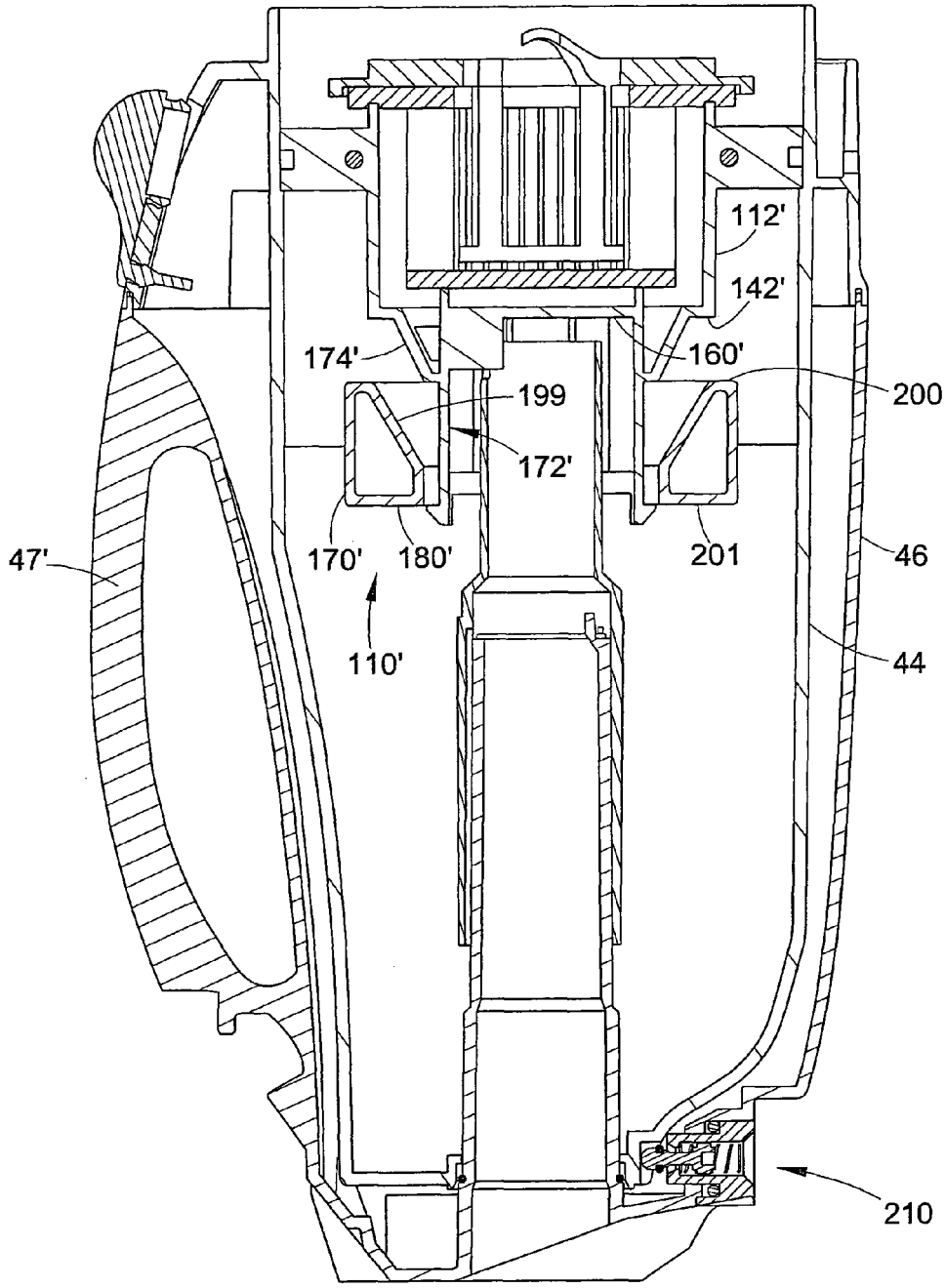
FIG. 12 is an enlarged side sectional view of a second embodiment of a float and filter assembly in a cleaning liquid and recovery container according to the present invention.

FIG. 12 shows an alternative embodiment of a float and filter assembly 110' where similar elements are denoted by a primed suffix (') and new elements are accorded new numerals. A float 170' lacks the frustoconical portion of the float 170 of FIG. 7. Instead, an annular float housing 180' defines a sloping inner surface 199 which engages a frustoconical portion 174' of a filter housing 112' when the float is in an upper position. An upper surface 200 of the float housing 180' engages a shelf 142' of the filter housing. Tangs 172' on the filter housing engage a lower surface 201 of the float housing.

With reference once more to FIG. 7, the liquid delivery system of the device will now be described. As discussed above, the container 43 defines an outer chamber 50 which receives a cleaning liquid, such as water, which may also include detergents, antiredeposition aids, and other components suitable for floor cleaning. An upper opening 202, defined in the wall 46 adjacent the carrying handle 47 of the container 43, is used for filling the chamber 50 with cleaning liquid. A resiliently flexible closure member 204 is attached to the wall by a grommet 206 and has a sealing ring 208 which frictionally engages the wall adjacent the opening 202 to seal the opening.

With continued reference to FIG. 7, the cleaning liquid exits the solution chamber via an outlet port 210, at a lower end of the wall 46. The outlet port 210 is fitted with a self closing valve 212 which automatically closes the outlet port when the container 43 is removed from the socket 41. The valve includes a pin 214, received within the port 210, which carries a sealing member 216, such as an o-ring. The pin 214 is biased to a closed position, in which the sealing member 216 engages a valve seat 218, by a bias spring 220. The valve 212 is opened by engagement of a tubular fitting 222 (FIG. 5) on one end of a solution supply tube 224 (indicated by a dashed line in FIG. 11), when the container 43 is inserted into the socket (FIG. 4).

Figure 11:
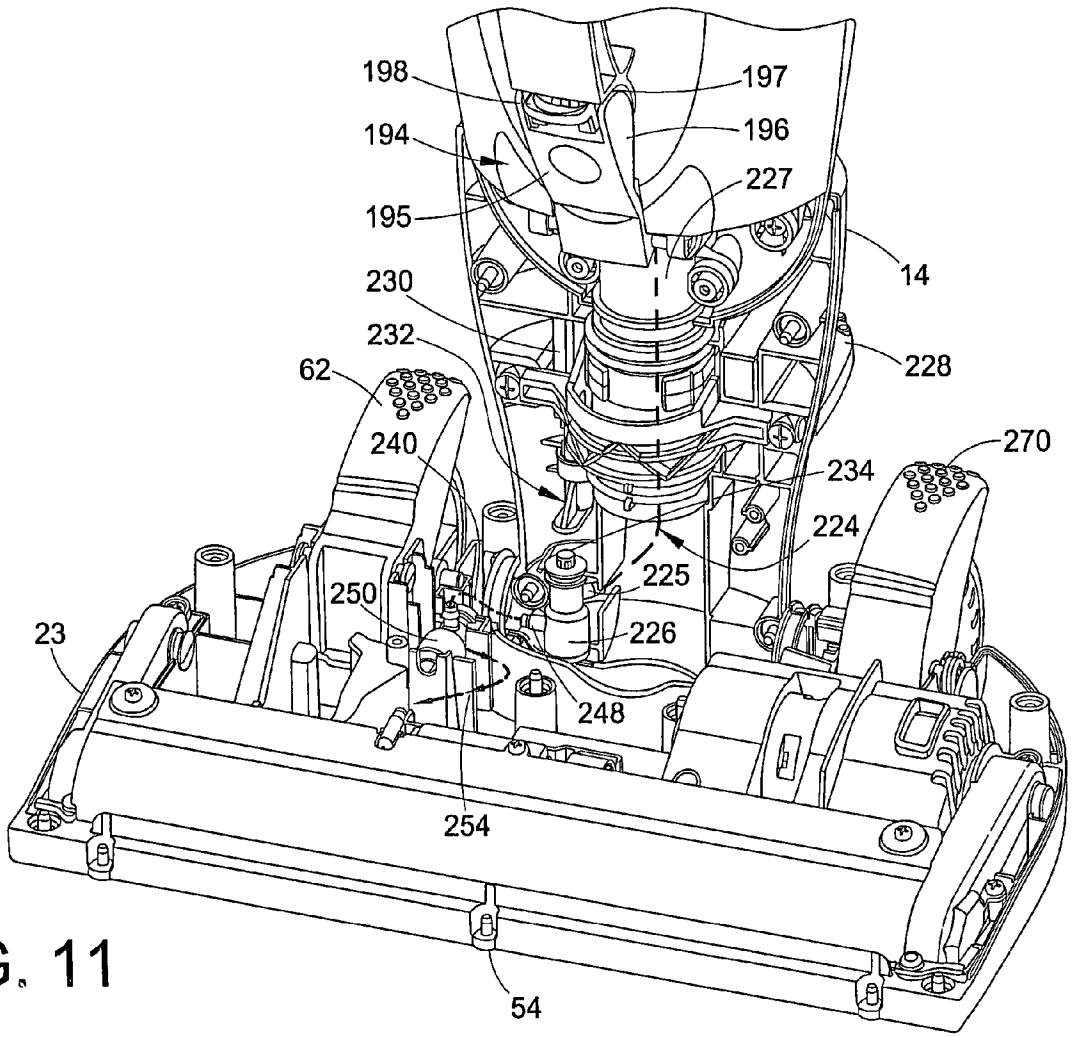
FIG. 11 is an enlarged perspective view of a lower end of the cleaning device of FIG. 1, with portions of the handle assembly and base removed.
Figure 13:
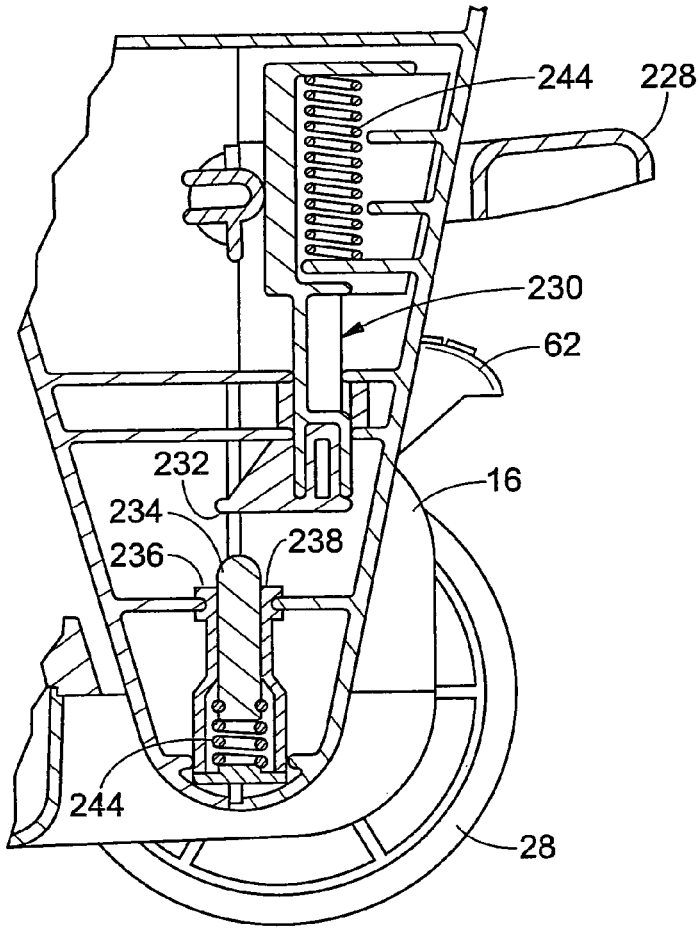
FIG. 13 is an enlarged side sectional view of a lower end of the handle assembly of the cleaning device of FIG. 1.

With continued reference to FIG. 11, the solution is carried by the supply tube 224 to an inlet 225 of a solution release valve 226. As illustrated in FIG. 13, the valve 226 is controlled by a pedal 228, pivotally mounted to a rear portion of the handle housing 40. The pedal 228 is operated by pressing downward with the foot, which causes a rod 230 to move upward, releasing an actuator 232 from engagement with a valve pin 234. This moves the pin away from a closed position, in which an elastomeric seal 236 engages a valve seat 238, releases cleaning liquid into a second fluid flow conduit 240 (FIG. 11), such as a tube. The valve pin 234 is normally biased to a closed position by a bias spring 242. In one embodiment, the rod 230 is biased by a spring 244 and is connected with the foot pedal by a ratchet mechanism. The valve can remain open until the foot pedal is depressed again. Alternatively, fluid flow can cease when pressure on the foot pedal is released.

Figure 14:
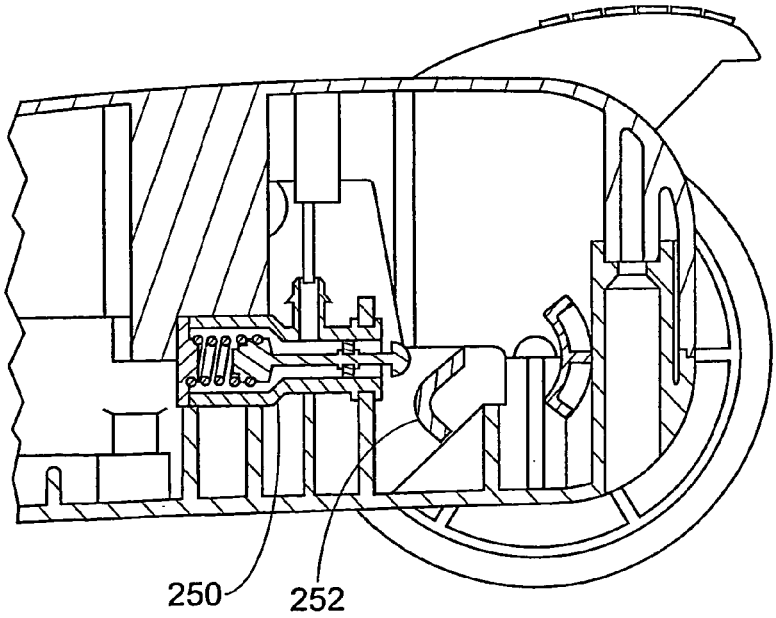
FIG. 14 is an enlarged side sectional view of a rear portion of the base of the cleaning device of FIG. 1.

The tube 240 (indicated by a dashed line in FIG. 11) connects an outlet port 248 of the valve with a second valve 250, mounted in the base. The valve 250 remains open whenever the handle assembly is in the operative position (i.e., angled). When the handle assembly is returned to its upright position, the valve 250 is closed by a cam mechanism 252 (FIG. 14). A third conduit 254 (indicated in FIG. 11 by a dashed line) connects the valve 250 with a liquid delivery outlet, such as a drip channel 260 (FIG. 6), from which the cleaning fluid drips on to the brushroll and the floor.

In the illustrated embodiment, the device operates by gravity feed of the cleaning liquid from the solution chamber to the drip channel. Alternatively, a pump (not shown) delivers cleaning liquid to a liquid delivery outlet, such as spray nozzles, adjacent the floor.

A pedal, 270 mounted to a rear of the base, allows the handle to be locked in the upright position and released by depression of the pedal.

To clean a floor, the user may first operate the cleaner in the dry mode (i.e., with the front end 54 raised) allowing the dry dirt to collect in the inner chamber 48 of the tank 42. In the dry mode, the switch 85 is actuated to power the fan motor 52 and optionally also the brushroll motor. The container need not be emptied before wet cleaning begins. Prior to wet cleaning, the front end is lowered by depression of pedal 62. Wet cleaning is commenced by applying cleaning liquid to the floor using the cleaning liquid release pedal 228, as needed. The cleaner is moved back and forth across the floor, the brushroll rotates scrubbing the floor and the squeegees aid in wet pickup. The suction fan 52 draws suction on the recovery chamber 48, pulling the dirty liquid into the chamber. As the liquid level rises, the float 170 moves upward in the chamber 48 and eventually seals the openings 146. This reduces or completely stops the suction on the suction nozzle and prevents further wet or dry pickup until the chamber 48 is emptied.

To empty the chamber 48, the latch 195 is released and the collection assembly 42 is removed from the socket 41. The float and filter assembly 110 is removed as a unit from the chamber 48 by pulling on the handle 134 and thereby overcoming the slight friction created by the gasket 138. The dirty liquid and collected dirt is then tipped from the chamber via the opening 111. At this time, the clean fluid chamber 50 can be refilled with fresh cleaning liquid. Periodically, the filter 114 is also removed from the filter housing 112 and any associated dirt brushed off or otherwise removed from the filter member and the filter housing emptied of any collected dirt. The filter is easily replaced in the filter housing before returning the float and filter assembly 110 to the container 43. The reassembled collection assembly 42 is then replaced in the socket 41, pushing the container 43 slightly upwardly to engage the gasket 193 of the fan and motor assembly 52, then locking the container to the housing 40.

Figure 15:
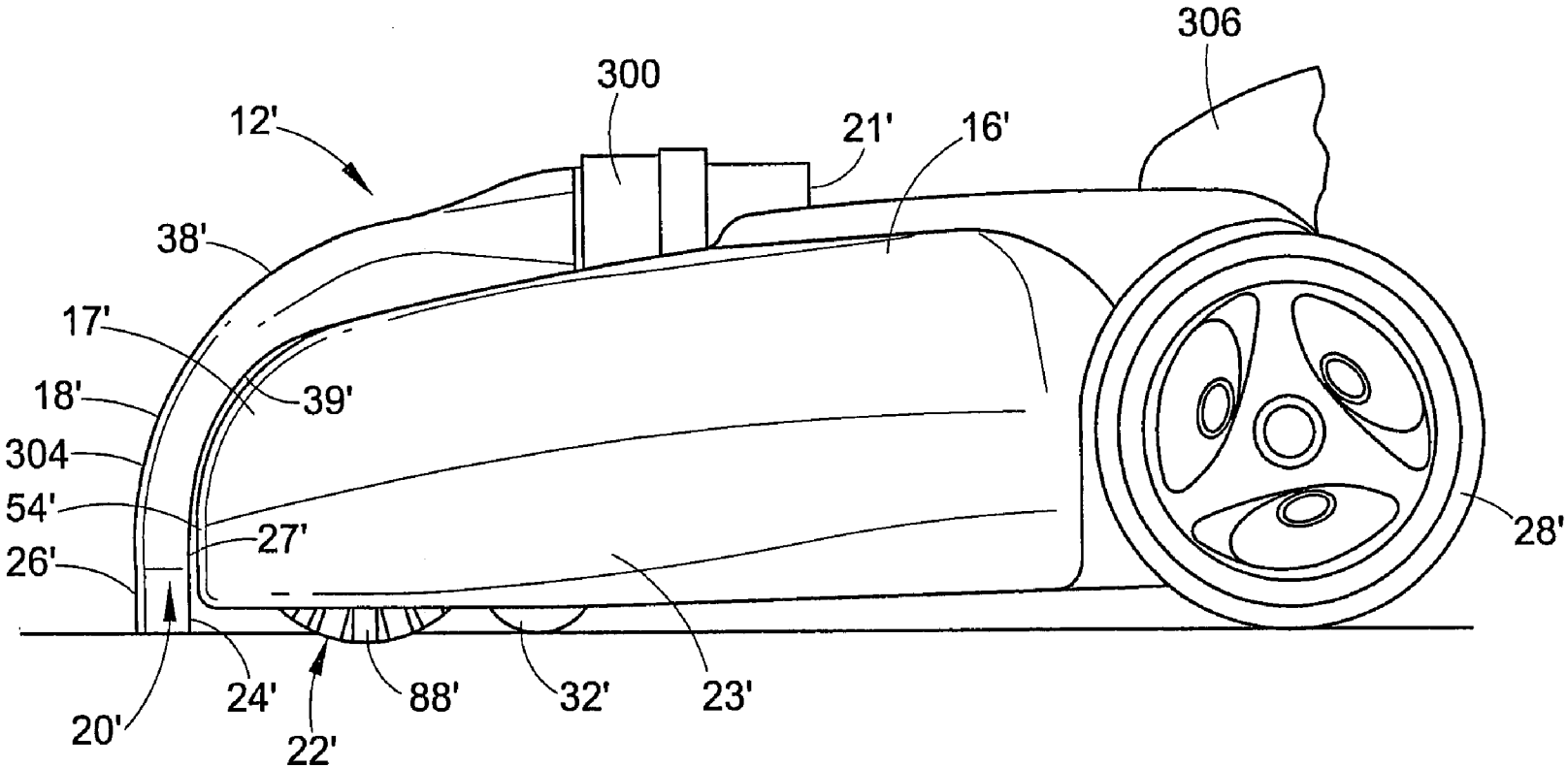
FIG. 15 is a side sectional view of a base of a second embodiment of a floor cleaning device according to the present invention with a nozzle assembly in a lower position.
Figure 16:
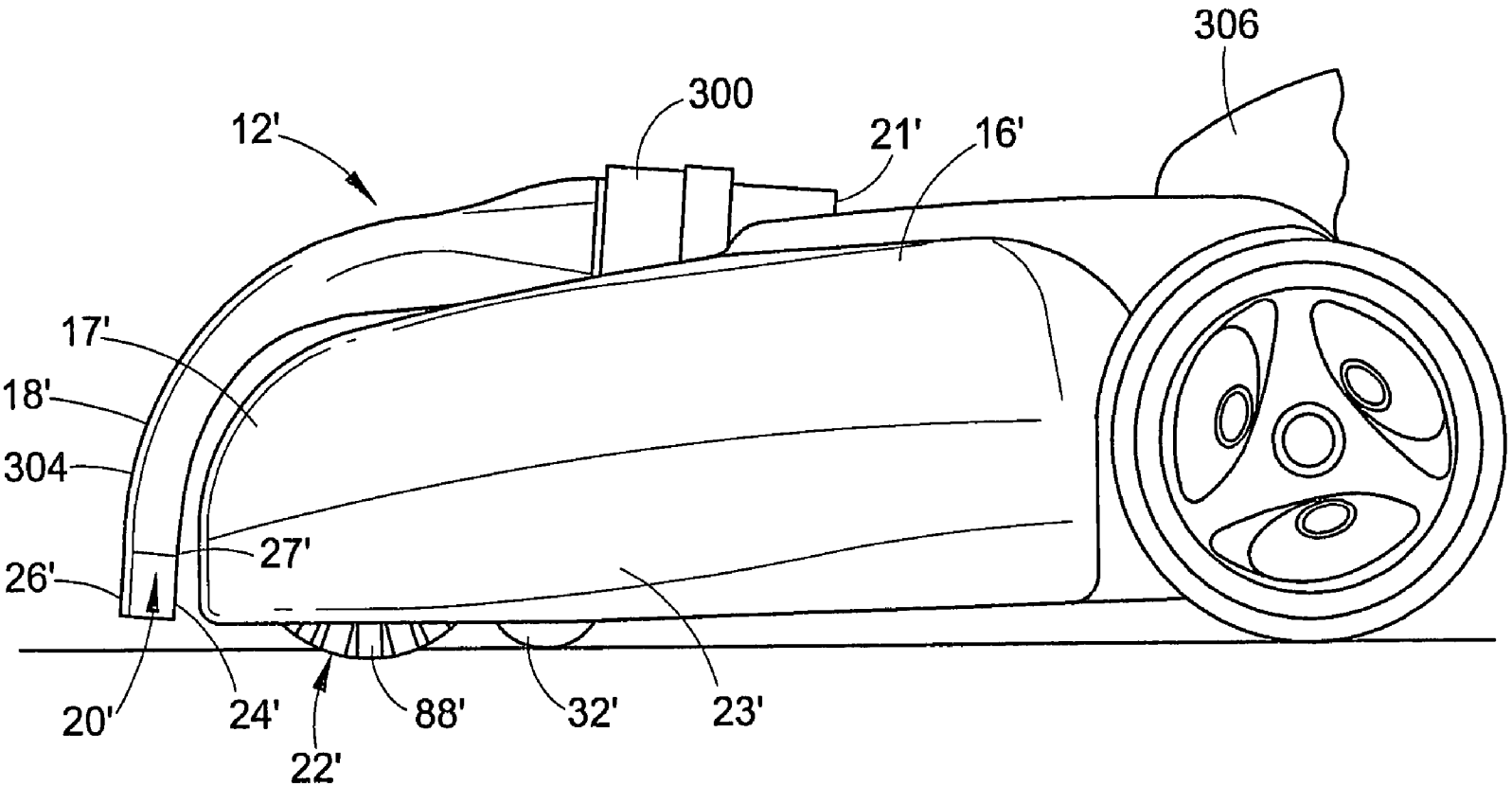
FIG. 16 is a side sectional view of the base of FIG. 15 with the nozzle assembly in a raised position.

With reference now to FIGS. 15 and 16, an alternative embodiment of a base for the cleaning device of FIG. 1 is shown. Similar elements are numbered with a primed suffix (') and new elements are given new numbers. The base 12' can be connected with a handle assembly similar to handle assembly 14, which is pivotally attached to the base. The base 12' includes a base housing 16' having upper and lower portions 17', 23'. A suction nozzle 18' overlies the upper portion 17' and defines a suction inlet 20', for recovery of dry dirt and/or dirty liquid from the floor and an outlet 21' in fluid communication with a container and suction source analogous to container 43 and suction source 50. An agitator 22', such as a rotating brush assembly, is carried by the lower portion 23' of the base housing 16' for scrubbing the floor.

Rotation members, such as rear wheels 28' are mounted to a rear of the base housing 16', on either side of the handle assembly. Forward rotation members, such as wheels or rollers 32' are optionally mounted to the base housing between the rear wheels and a forward end 54' of the housing (FIG. 15). The base 12' lacks the pivotable carriage assembly 36 of the embodiment of FIG. 3.

Rear and front squeegees 24', 26' are mounted by a squeegee support 27' to the suction nozzle 18' in a similar manner to the embodiment of FIG. 6, such that they are positioned rearward and forward of the suction inlet 20'.

The suction nozzle 18' may be formed from upper and lower members 38', 39', which are connected together to define the inlet 20' and the outlet 21' and a portion of a fluid flowpath A therebetween. The upper member 38' defines an upper surface of the suction nozzle and the lower member 39' defines a lower surface of the suction nozzle. The suction nozzle 18' is movable between a first or lower position, in which the nozzle inlet 20' is adjacent the floor and the squeegees 24', 26' contact the floor to aid in liquid pickup, and a second, or upper position, in which the squeegees are raised from the floor, to allow improved pickup of dry dirt. In the lower position, the lower nozzle member 39' is in contact with or lies closely adjacent to the upper portion 17' of the base housing (FIG. 15). In the raised position, the lower nozzle member is at least partially spaced from the base housing (FIG. 16). Specifically, a rear end 300 of the suction nozzle 18' is pivotally connected with the base housing at pivot points (not illustrated) whereby a forward end 304 of the nozzle can be raised or lowered. A pedal 306, mounted to the base housing is operatively connected with a known lifting mechanism (not illustrated) for selectively raising and lowering the suction nozzle 18'. Alternatively, the suction nozzle 18' may be raised or lowered manually, by grasping the forward end 304.

The agitator 22' includes a brushroll 88', which is mounted to the base housing and is rotated by a brushroll motor, analogous to motor 86. It will be appreciated that, in this embodiment, since the squeegees 24', 26' are flexible, the front end 54' of the base housing is not lifted up when the squeegees are in the lower, floor contacting position. Thus, the brushroll 88' makes contact with the floor surface in both the raised and lowered nozzle positions.

Other aspects of the floor cleaning device can be analogous to those of the device of FIGS. 1 to 14.

Figure 17:
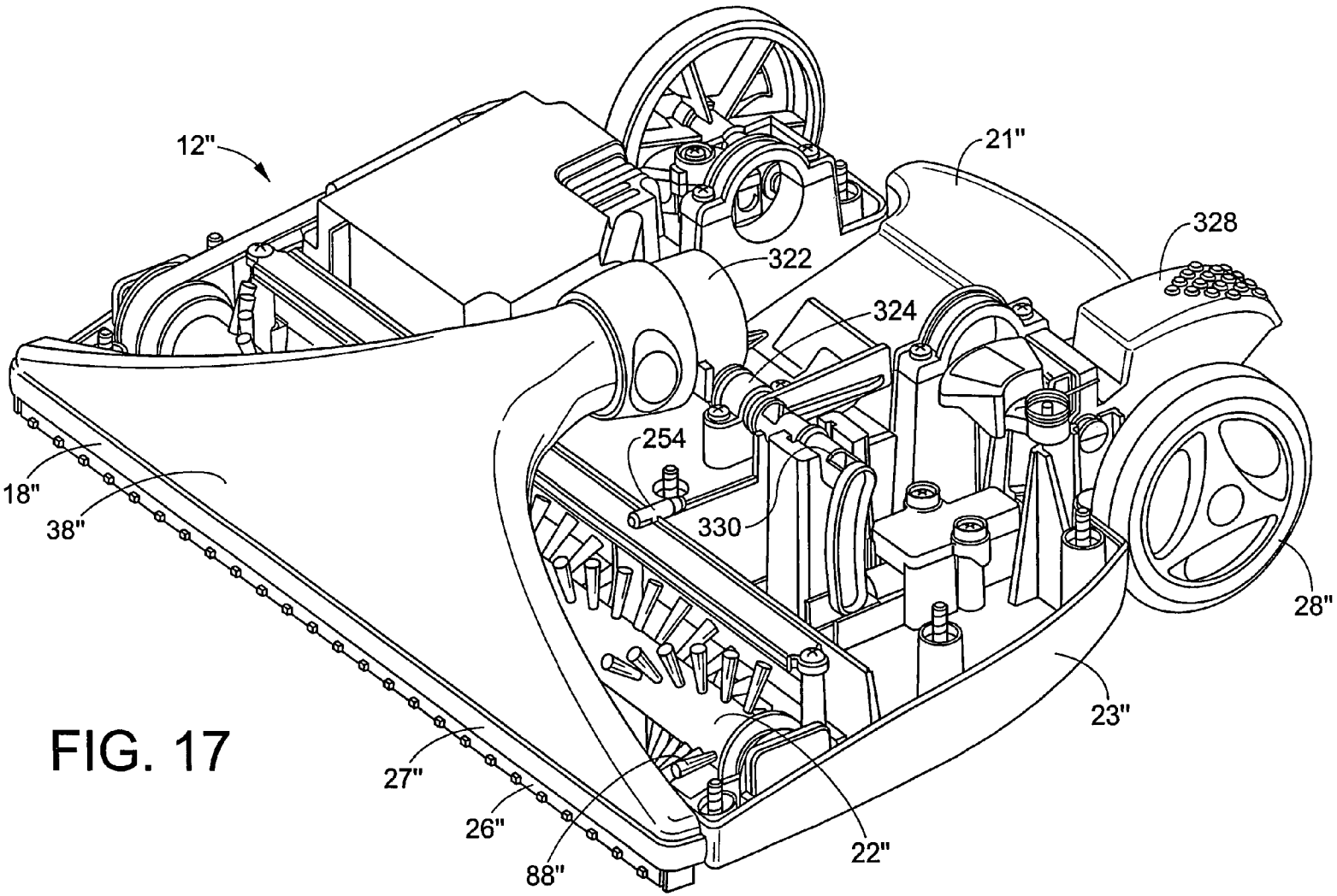
FIG. 17 is a perspective view of a base of a third embodiment of a floor cleaning device according to the present invention with a hard floor cleaning nozzle, and an upper housing portion removed for clarity.
Figure 18:
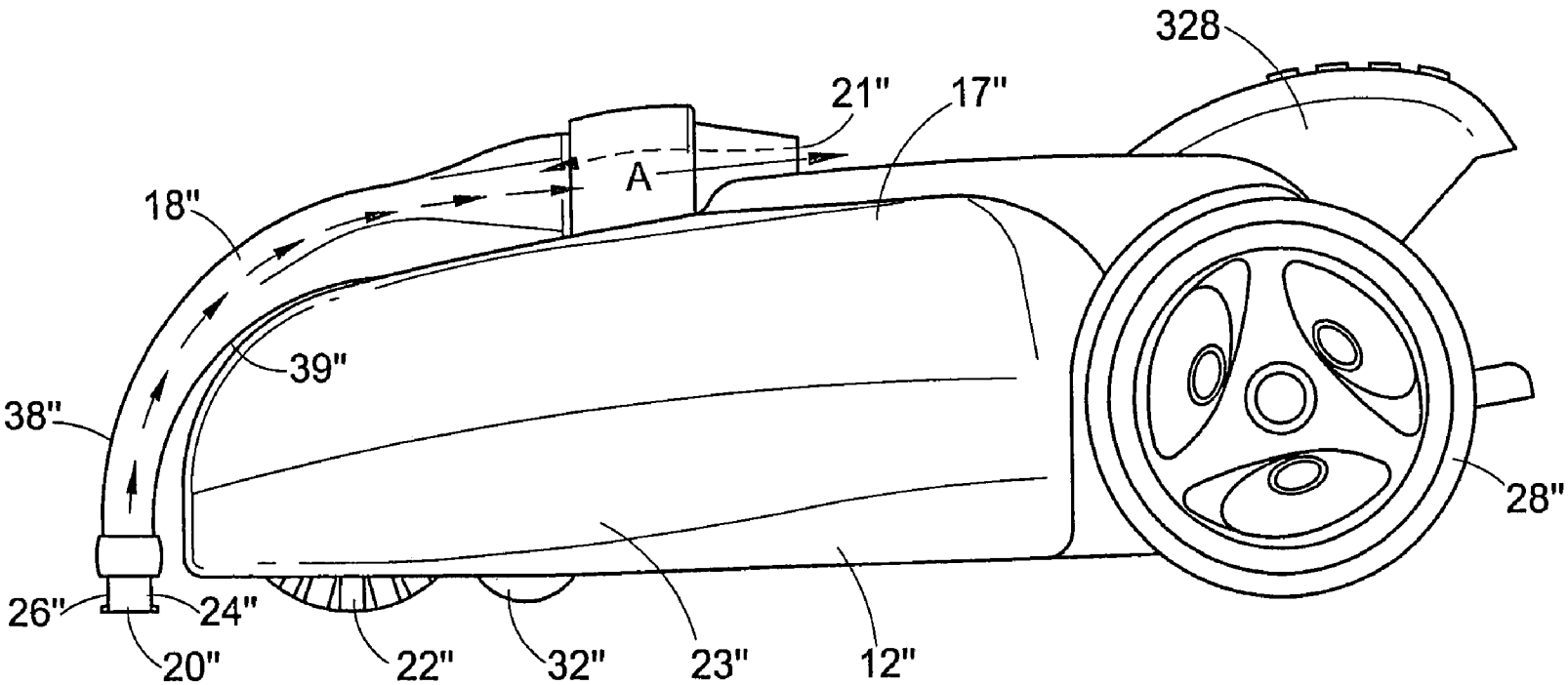
FIG. 18 is a side view of the base of FIG. 17 with the suction nozzle in a lowered position.

With reference now to FIGS. 17-21, an alternative embodiment of a base for the cleaning device of FIG. 1 is shown. Similar elements are numbered with a double primed suffix (") and new elements are given new numbers. The base 12" can be connected with a handle assembly similar to handle assembly 14, which is pivotally attached to the base. The base 12" includes a base housing 16" having upper and lower portions 17", 23" (FIG. 18). A suction nozzle 18" overlies the upper portion 17" and defines a suction inlet 20", for recovery of dry dirt and/or dirty liquid from the floor and an outlet 21" in fluid communication with a container and suction source, analogous to container 43 and suction source 50. An agitator 22", such as a rotating brush assembly, is carried by the lower portion 23" of the base housing 16" for scrubbing the floor.

Rotation members, such as rear wheels 28" are mounted to a rear of the base housing 16", on either side of the handle assembly. Forward rotation members, such as wheels or rollers 32" are optionally mounted to the base housing between the rear wheels and a forward end 54" of the housing (FIG. 17). The base 12" lacks the pivotable carriage assembly 36 of the embodiment of FIG. 3.

Rear and front squeegees 24", 26" are mounted by a squeegee support 27" to the suction nozzle 18" in a similar manner to the embodiment of FIG. 6, such that they are positioned rearward and forward of the suction inlet 20".

Figure 19:
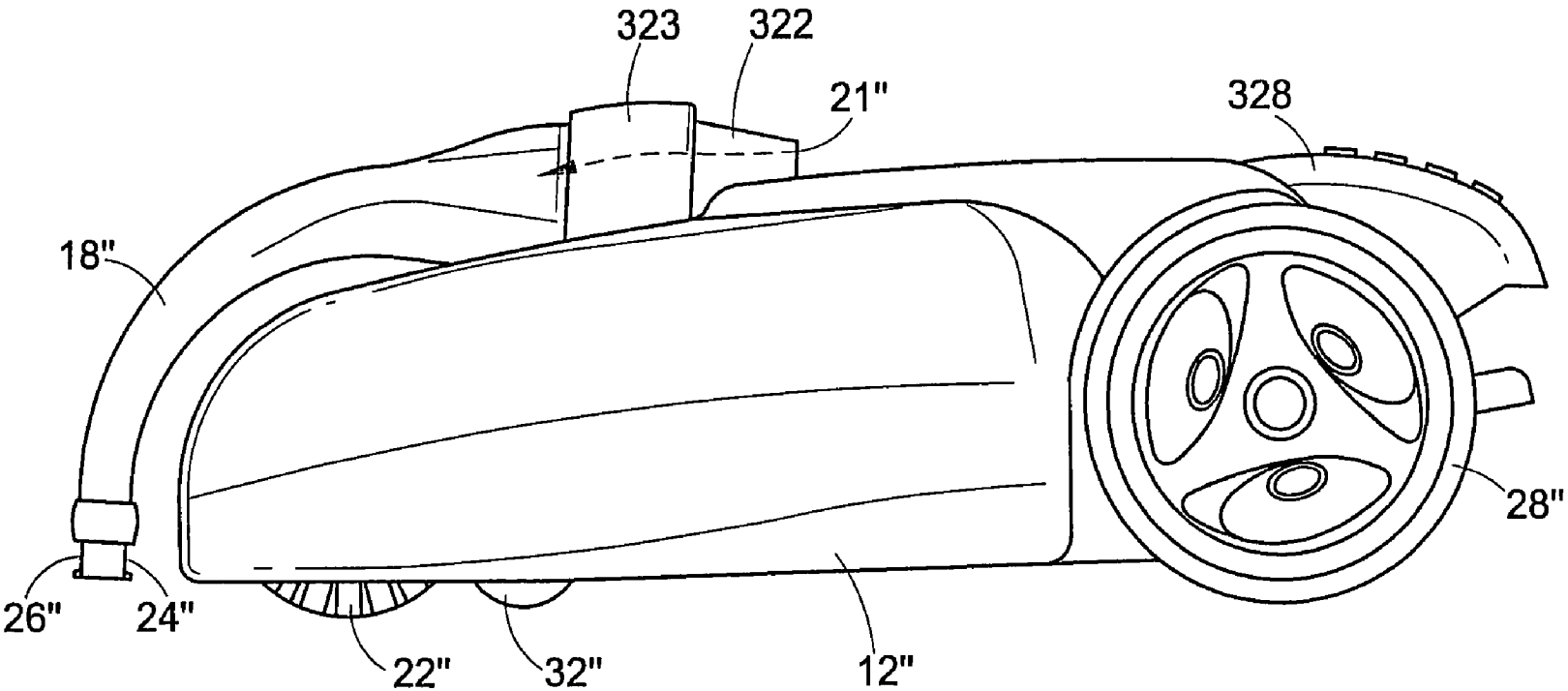
FIG. 19 is a side view of the base of FIG. 17 with the suction nozzle in a raised position.
Figure 20:
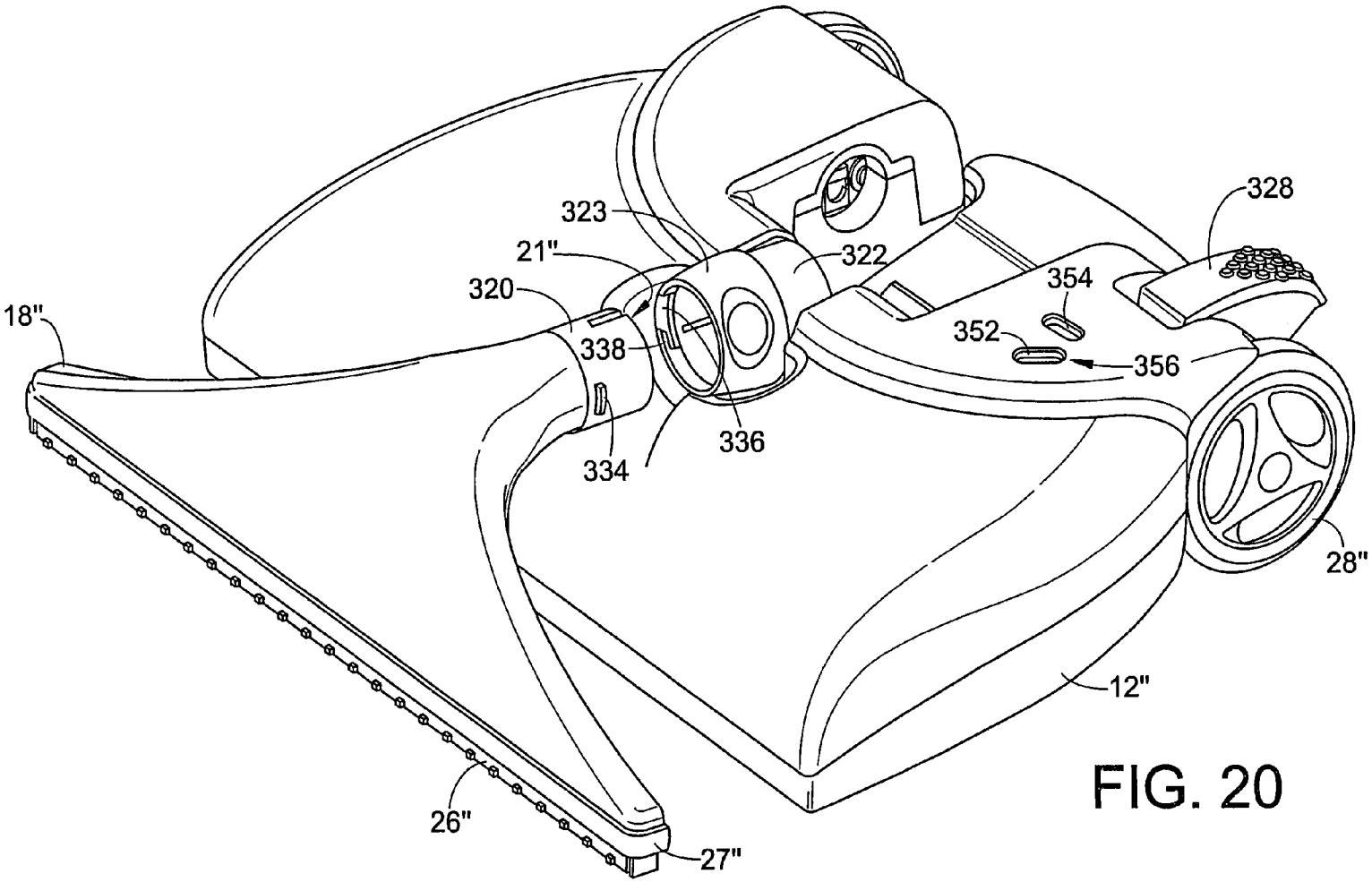
FIG. 20 is a perspective view of the base of FIG. 17 with the hard floor nozzle removed.

The suction nozzle 18" may be formed from upper and lower members 38", 39", which are connected together to define the inlet 20" and the outlet 21" and a portion of a fluid flowpath A therebetween (FIG. 18). The upper member 38" defines an upper surface of the suction nozzle and the lower member 39" defines a lower surface of the suction nozzle 18". The suction nozzle 18" is movable between a first or lower position (FIG. 18), in which the nozzle inlet 20" is adjacent the floor and the squeegees 24", 26" contact the floor to aid in liquid pickup, and a second, or upper position (FIG. 19), in which the squeegees are raised from the floor, to allow improved pickup of dry dirt. In the lower position, the lower nozzle member 39" is in contact with or lies closely adjacent to the upper portion 17" of the base housing (FIG. 18). In the raised position, the lower nozzle member is at least partially spaced from the base housing (FIG. 19). Specifically, as shown in FIG. 20, a tubular-shaped rear end 320 of the suction nozzle 18" is removably secured to a conduit 322. Mounted on the conduit is a receiving collar 323. The conduit 322 is pivotally connected with the base housing at pivot points 324 (FIG. 17), whereby a forward end 326 of the nozzle can be raised or lowered. The conduit 322 defines a portion of the fluid flowpath A. A pedal 328, mounted to the base housing, is operatively connected with a lifting mechanism 330 for selectively raising and lowering the suction nozzle 18". Alternatively, the suction nozzle 18" may be raised or lowered manually, by grasping the forward end 326.

As shown in FIG. 20, an engagement member or members 334 on the rear end 320 of the suction nozzle 18" engage a corresponding engagement member or members 336 on the collar 323 to lock the suction nozzle to the conduit 322. Specifically, a projection 334 on an outer surface of the suction nozzle rear end 320 is received in a corresponding groove 336 defined in an interior wall of the collar 323. Rotation of the collar 323 on the receiving tube 322 in a clockwise direction causes the projection 334 to engage a stop 338, thereby resisting removal of the nozzle without a rotation of the collar in the reverse direction. The rotation can be small, on the order of a quarter turn or an eighth turn, for ease of use.

The agitator 22" includes a brushroll 88", which is mounted to the base housing and is rotated by a brushroll motor analogous to motor 86. It will be appreciated that, in this embodiment, since the squeegees 24", 26" are flexible, the front end 54' of the base housing is not lifted up when the squeegees are in the lower, floor contacting position. Thus, the brushroll 88" makes contact with the floor surface in both the raised and lowered nozzle positions.

Figure 21:
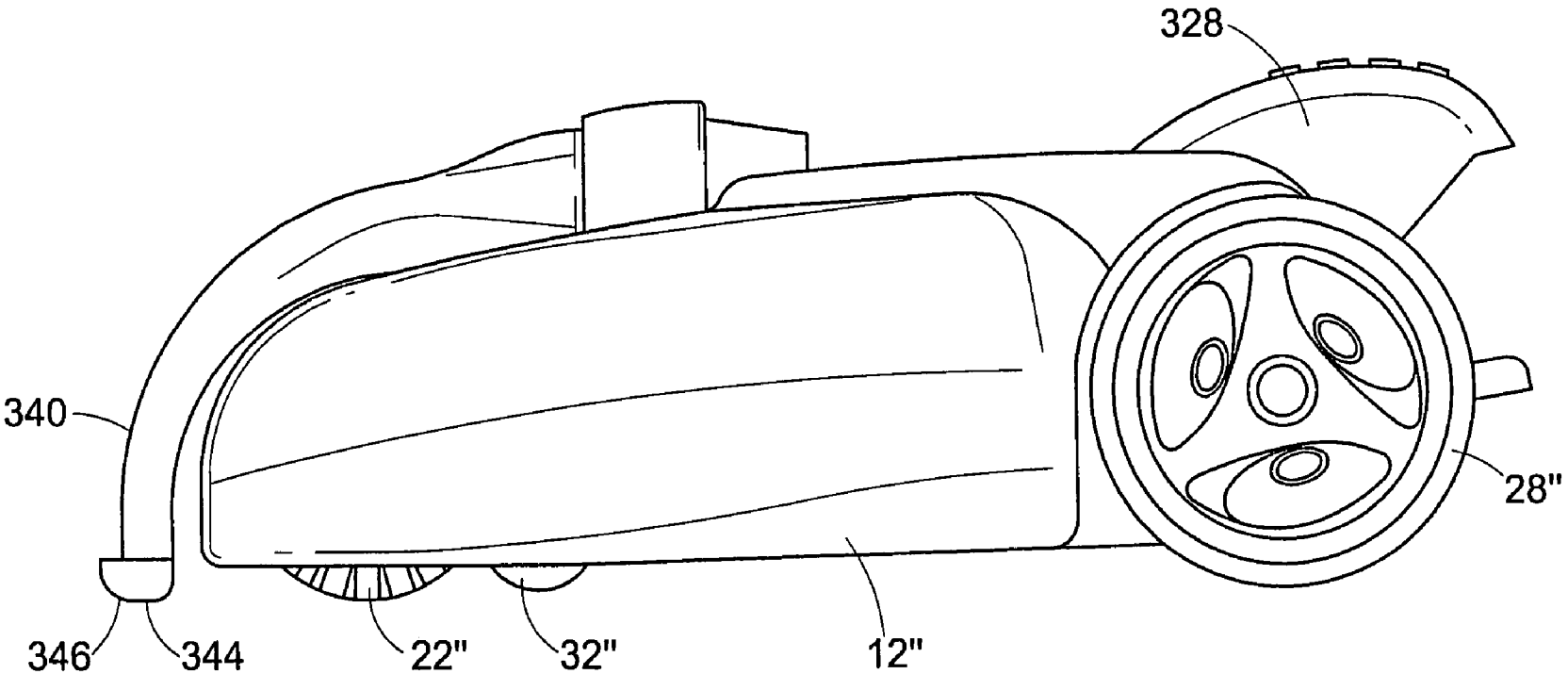
FIG. 21 is a side view of the base of FIG. 17 with a carpet cleaning nozzle in a lower position.

The suction nozzle 18" is primarily suited to cleaning of hard floors, such as linoleum, wood, ceramic tile, cork, and the like. For cleaning of soft floors, such as carpets, a second suction nozzle 340 can be substituted for the nozzle 18" (FIG. 21). The carpet cleaning nozzle is similarly configured to the nozzle 18" but in place of the squeegees, it has a suction nozzle inlet 344 formed in a lower wall 346 of the nozzle 340. The lower wall is generally horizontal, with upturned forward and rear ends adapted to sliding across a carpeted surface. The nozzle 340 is illustrated in FIG. 21 in a raised position. As with the nozzle 18", suction nozzle 340 can be lowered to a position in which the inlet 344 is closely adjacent to the floor surface and the lower wall 346 may engage the carpet (not shown).

To exchange the nozzles 18", 340, the pedal 328 can be operated to lift the particular nozzle in use off the floor. The collar 323 is then rotated counterclockwise a portion of a turn and the nozzle withdrawn from engagement with the collar. The other nozzle can then be inserted and locked into position. Optionally a storage member, such as a clip (not shown), on the handle assembly 14 of the floor cleaning device allows the suction nozzle not in use to be stored. A display 350 (FIG. 20) provides an indication to the operator as to the position of the nozzle. For example, the display includes windows 352, 354. A colored region situated beneath the housing is displayed in window 352 when the nozzle is in the lowered position and is pivoted to a position where it is viewed through the second window 354 when the pedal 328 is actuated to move the nozzle to the raised position.

Other aspects of the floor cleaning device can be analogous to those of the device of FIGS. 1 to 16.

In yet another embodiment (not shown) the squeegees of the floor cleaning device of FIGS. 1-16 are removable. For example, the squeegees support 27, 27' includes engagement members (not shown) for selectively engaging the suction nozzle 18, 18'. The squeegees may thus be removed, for example, for using the floor cleaning device for removal of dry dust or for cleaning carpeted floors.

While the invention has been described with reference to a base housing 12, 12', 12" and an upper housing 40, these separate housings can be considered to constitute parts of an overall housing for the cleaning device. Moreover the components, such as the suction source 52, fluid collection assembly 42, and liquid delivery pump (where used) may be mounted on the housing in location other than those specifically mentioned herein.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A floor cleaning device comprising:

a base portion for movement along a surface;

a handle portion pivotally connected to said base portion;

a nozzle assembly associated with said base portion and movable in relation to said base portion, said nozzle assembly including a nozzle body and a squeegee attached to said nozzle body, said nozzle assembly being removably mounted on said base portion by a connector which connects the nozzle assembly with a conduit that defines a portion of a fluid flowpath;

a brush assembly associated with said base portion, said brush assembly comprising an agitator; and, wherein said nozzle assembly is, in a first position raised off the surface for vacuuming the surface, said nozzle assembly being lowered to a second position contacting the surface for picking up liquid and dirt from the surface, and a height of said base portion in relation to the surface remains unchanged in the first and second positions of said nozzle assembly.

2. The floor cleaning device of claim 1 further comprising an actuator operatively connected to said base portion such that said actuator selectively raises said nozzle assembly from said second position, in which it contacts the surface, to said first position.

3. The floor cleaning device of claim 1 further comprising a motor for driving said agitator.

4. The floor cleaning device of claim 3 wherein said agitator comprises a brushroll and further comprising a drive belt drivably connected between said motor and said brushroll.

5. The floor cleaning device of claim 3 further comprising a switch for selectively actuating said motor.

6. The floor cleaning device of claim 1, wherein the nozzle assembly is removably connected with the base solely by the connector.

7. A floor cleaning device comprising:

a base portion for movement along a surface, said base portion including a distributor for distributing cleaning liquid onto the surface;

rotation members connected to said base portion and engaging the surface;

a handle portion pivotally connected to said base portion;

a nozzle assembly associated with said base portion and movable in relation thereto, said nozzle assembly including a nozzle body composed of a relatively rigid material, said nozzle assembly including a squeegee attached to said nozzle body, the nozzle body including a tubular rear end which defines a fluid outlet, the tubular rear end being removably secured to a fluid conduit by a receiving collar;

a brush assembly associated with said base portion, the brush assembly including an agitator;

a motor for driving said agitator; and an actuator operatively connected to said base portion such that actuating said actuator moves said nozzle assembly in relation to said base portion between a first position raised off of the surface to vacuum the surface, and a second position in which said squeegee engages the surface to collect and pick up liquid and dirt from the surface, wherein a height of said base portion in relation to the surface remains unchanged as said nozzle assembly is moved to said first and second positions.

8. The floor cleaning device of claim 7 wherein said nozzle assembly is removably mounted on said base portion.

9. The floor cleaning device of claim 7 including a retainer mounted to said nozzle body, said squeegee being attached to said retainer.

10. The floor cleaning device of claim 7 wherein said actuator comprises a pedal operatively connected to said base portion such that depressing said pedal moves said nozzle assembly to one of said first position and said second position.

11. The floor cleaning device of claim 7 wherein said rotation members include a pair of wheels rotatably connected on opposite sides of said base.

12. The floor cleaning device of claim 7 further comprising:

a suction source communicating with said nozzle, said suction source being supported by one of said base portion and said handle portion; and a container supported by one of said base portion and said handle portion for receiving dirt from the surface.

13. The floor cleaning device of claim 7 further comprising a connection assembly for selectively connecting said nozzle to said base member.

14. The floor cleaning device of claim 13 wherein the adjustment mechanism is connected to the connection assembly, whereby when the nozzle is removed, it is disconnected from the actuator.

15. A cleaning device comprising:

a base;

a handle pivotally connected to said base;

a container carried by one of said base and said handle for receiving dirt from a surface to be cleaned;

a reservoir carried by one of said base and said handle for supplying a cleaning solution to the surface to be cleaned;

a source of suction carried by one of said base and said handle and in fluid communication with said container;

an agitator rotatably mounted to said base;

a suction nozzle carried by said base, the suction nozzle including an inlet, forward of said agitator, for receiving dirt from the surface to be cleaned and tubular outlet, rearward of said agitator; and, an adjustment mechanism for moving said suction nozzle, relative to said base, between a first position, in which said inlet is located adjacent the surface to be cleaned and a second position, in which said inlet is spaced from the surface, said adjustment mechanism pivoting the suction nozzle at a pivot point connected to the outlet.

16. The cleaning device of claim 15, further including at least one squeegee mounted to said suction nozzle adjacent said inlet, said squeegee contacting the surface to be cleaned when said suction nozzle is in the first position and being spaced from the surface when said suction nozzle is in the second position.

17. The cleaning device of claim 15, wherein said adjustment mechanism includes a pivoting link for pivotally connecting said suction nozzle to said base.

18. The cleaning device of claim 17, wherein said adjustment mechanism further comprises a pedal operatively connected to said pivoting link.

19. The cleaning device of claim 15, further comprising a motor for driving said agitator.

20. The cleaning device of claim 19, wherein said agitator comprises a brushroll and further comprising a drive belt drivably connected between said motor and said brushroll.

21. A cleaning device comprising:

a base;

a handle pivotally connected to said base;

a container carried by one of said base and said handle for receiving dirt from a surface to be cleaned;

a reservoir carried by one of said base and said handle for supplying a cleaning solution to the surface to be cleaned;

a source of suction carried by one of said base and said handle and in fluid communication with said container;

an agitator rotatably mounted to said base;

a suction nozzle removably connected to said base by a connector which connects the suction nozzle with a conduit which defines a fluid flowpath fluidly connecting the suction nozzle with the source of suction, the suction nozzle including an inlet for receiving dirt from the surface to be cleaned and an outlet; and an adjustment mechanism for moving said suction nozzle, relative to said base, between a first position, in which said inlet is located adjacent the surface to be cleaned and a second position, in which said inlet is spaced from the surface, the adjustment mechanism being connected with the conduit, wherein disconnecting the nozzle from the connector disconnects the suction nozzle from the adjustment mechanism.

* * * * *